US008475107B2

(12) United States Patent
Haramiishi

(10) Patent No.: US 8,475,107 B2
(45) Date of Patent: Jul. 2, 2013

(54) PAPER-SHEET HANDLING DEVICE

(75) Inventor: Kiichi Haramiishi, Gunma (JP)

(73) Assignee: Max Co., Ltd., Tokyo (JP)

( * ) Notice: Subject to any disclaimer, the term of this patent is extended or adjusted under 35 U.S.C. 154(b) by 633 days.

(21) Appl. No.: 12/065,168

(22) PCT Filed: Aug. 29, 2006

(86) PCT No.: PCT/JP2006/317003

§ 371 (c)(1),
(2), (4) Date: Feb. 28, 2008

(87) PCT Pub. No.: WO2007/026710

PCT Pub. Date: Mar. 8, 2007

(65) Prior Publication Data

US 2009/0232621 A1 Sep. 17, 2009

(30) Foreign Application Priority Data

Sep. 2, 2005 (JP) ..... 2005-255332

(51) Int. Cl.

| | |
|---|---|
| ***B42C 9/00*** | (2006.01) |
| ***B42C 11/00*** | (2006.01) |
| ***B42C 5/02*** | (2006.01) |
| ***B42B 5/08*** | (2006.01) |
| ***B42B 5/00*** | (2006.01) |
| ***B42B 5/10*** | (2006.01) |
| ***B42B 9/00*** | (2006.01) |

(52) U.S. Cl.

USPC ..... 412/34; 412/6; 412/7; 412/9; 412/18; 412/30; 412/33; 412/38; 412/39; 412/40; 412/42

(58) Field of Classification Search

USPC ..... 281/51; 283/117; 412/4, 5, 6, 7, 412/9, 18, 19, 20, 21, 24, 30, 33, 34, 38, 412/39, 40, 42

See application file for complete search history.

(56) References Cited

U.S. PATENT DOCUMENTS 2,963,049 A 12/1960 Biel et al.
3,761,983 A 10/1973 Staats (Continued)

FOREIGN PATENT DOCUMENTS

JP 2005059396 3/2005
JP 2005138549 6/2005

(Continued)

*Primary Examiner* — Dana Ross
*Assistant Examiner* — Justin V Lewis
(74) *Attorney, Agent, or Firm* — Chernoff Vilhauer McClung & Stenzel LLP

(57) ABSTRACT

A paper-sheet handling device relating to the present invention has a configuration such that a binder paper alignment unit for temporarily reserving a plurality of paper-sheets perforated at predetermined positions, a movement mechanism for binding the bundle of paper-sheets thus aligned owing to the above by means of a binding component, and a binder cassette for storing the binding components for being transferred thereto, wherein the movement mechanism is arranged on the downstream side of the binder paper alignment unit and the binder cassette and also, the binder paper alignment unit and the binder cassette are arranges radially on the upstream side to form an approximately V-shape by making the aforesaid movement mechanism to be a reference. It is possible depending on this configuration to concentrate the necessary constructional elements at the periphery of the movement mechanism, so that the arrangement of the component members in the horizontal direction of the device can be restricted and the aforesaid device can be miniaturized.

7 Claims, 32 Drawing Sheets

U.S. PATENT DOCUMENTS

| | | | | |
|---|---|---|---|---|
| 5,249,902 | A * | 10/1993 | Stankiewicz | 412/7 |
| 6,042,320 | A * | 3/2000 | McHenry et al. | 412/39 |
| 6,171,044 | B1 * | 1/2001 | De La Torre | 412/4 |
| 2004/0207153 | A1 | 10/2004 | Kida | |
| 2008/0075560 | A1 | 3/2008 | Kurabayashi et al. | |

FOREIGN PATENT DOCUMENTS

| | | |
|---|---|---|
| WO | 2005014301 | 2/2005 |
| WO | 2005044580 | 5/2005 |

* cited by examiner

PAPER-SHEET HANDLING DEVICE

This is a national stage application filed under 35 USC 371 based on International Application No. PCT/JP2006/317003 filed Aug. 29, 2006, and claims priority under 35 USC 119 of Japanese Patent Application No. 2005-255332 filed Sep. 2, 2005.

TECHNICAL FIELD

This invention relates to a paper-sheet handling device that is preferably applied to an automatic binder which binds recording paper-sheets released from a copy machine or a print machine with them being aligned. Particularly, it has such a configuration that binding means is arranged on a downstream side of paper-sheet reserving means and consumables storing means and also, the paper-sheet reserving means and the consumables storing means are arranged radially on the upstream side to form an approximately V-shape space by making aforesaid binding means to be a reference, by which two processes of the separation acquisition of the binding component and the binding process by the binding component can be executed centering around the axis, thereby enabling necessary constructional elements to gather around the binding means, and at the same time, enabling the arrangement of the component members in the horizontal direction of the device to be restricted.

BACKGROUND ART

In recent years, a case in which a copy machine, a print machine or the like for black-and-white use and for color use is used by combining a post-processing device for post-processing such as punching, binding or the like with the machine has been increased. According to this kind of post-processing device, paper-sheets after the print are received and are perforated by utilizing a punching function provided on a downstream side of the paper-sheets. The paper-sheets after the perforation are aligned once again and a binding process of a ring band or the like is employed automatically by utilizing the perforation thereof.

With reference to this kind of bind function, a binding processing device has been disclosed in Japanese unexamined patent publication No. 2005-138549 (see Page 3, FIG. 1). According to this binding processing device, it is configured that a paper-sheet transport path bends to the down direction on the downstream side of a punch mechanism unit, and the paper-sheet aligning unit, the binding processing mechanism unit and the binder cartridge (hereinafter, referred to as binding units) are arranged in this direction on a straight line, as well as by integrating the punch mechanism unit perforating punch holes at the paper-sheet and the binding processing mechanism unit mounting a ring type binder at the punch holes, the punching processing process and the binding processing process can cooperate with each other. Such a configuration of the device enables an efficiency of the binding process to be improved.

However, according to the binding processing device as seen in Japanese unexamined patent publication No. 2005-138549 (see Page 3, FIG. 1), the paper-sheet aligning unit (hereinafter, also referred to as paper-sheet reserving means), the binding processing mechanism unit (hereinafter, also referred to as binding means) and the binder cartridge are arranged on a straight line, so that there are problems as follows.

i. The whole of binding unit becomes long, and in case of seeing the binding processing device as a finisher of a picture forming device such as a copy machine, a printing machine and the like, it happens that the binding processing device becomes large-sized one as compared with the picture forming device.

ii. Incidentally, when miniaturization of the binding processing device is attempted by reducing the mounting space of the binder cartridge, it happens that the number of loading of the consumables which can be stored in the binder cartridge (hereinafter, also referred to as consumables storing means) is decreased (be downed).

iii. By practicing the binding process on the straight line, productivity is deteriorated because the parallel processing is difficult. Thus, it happens that speeding up of the binding process is prevented.

DISCLOSURE OF THE INVENTION

A paper-sheet handling device according to the present invention contains paper-sheet reserving means for temporarily reserving a plurality of paper-sheets which are perforated at predetermined positions with being aligned, binding means for binding a bundle of paper-sheets aligned by the paper-sheet reserving means using a binding component, and consumables storing means for storing the binding component to be transferred to the binding means. In the aforesaid paper-sheet handling device, it is configured that the binding means is arranged on a downstream side of the paper-sheet reserving means and the consumables storing means and also, the aforesaid binding means is provided displaceably at a position facing the aforesaid paper-sheet reserving means and at a position corresponding to the aforesaid consumables storing means.

According to the paper-sheet handling device relating to the present invention, the binding means is, for example, arranged in a region where a direction in which a bundle of paper-sheets is released from the paper-sheet reserving means to the downstream side and a direction in which consumables are released from the consumables storing means to the downstream side are intersected, and the paper-sheet reserving means and the consumables storing means are arranged radially on the upstream side by making the binding means to be a reference.

Consequently, not only two processes of the separation acquisition of the binding component and the binding process by the binding component can be executed centering the axis, but also necessary constructional elements can gather around the binding means, so that the arrangement of the component members in the horizontal direction of the device can be restricted. This enables such a configuration that these constitution members are arranged on a straight line to be avoided, thereby allowing miniaturization of the paper-sheet handling device to be realized.

BEST MODE FOR CARRYING OUT THE INVENTION

The present invention has an object to provide a paper-sheet handling device in which it becomes possible for the aforesaid device to be miniaturized by devising the arrangement of the paper-sheet reserving means, the consumables storing means, and the binding means without arranging these constitution members on a straight line.

Hereinafter, the paper-sheet handling device relating to an exemplified embodiment of this invention will be explained with respect to with reference to the drawings.

Figure 1:
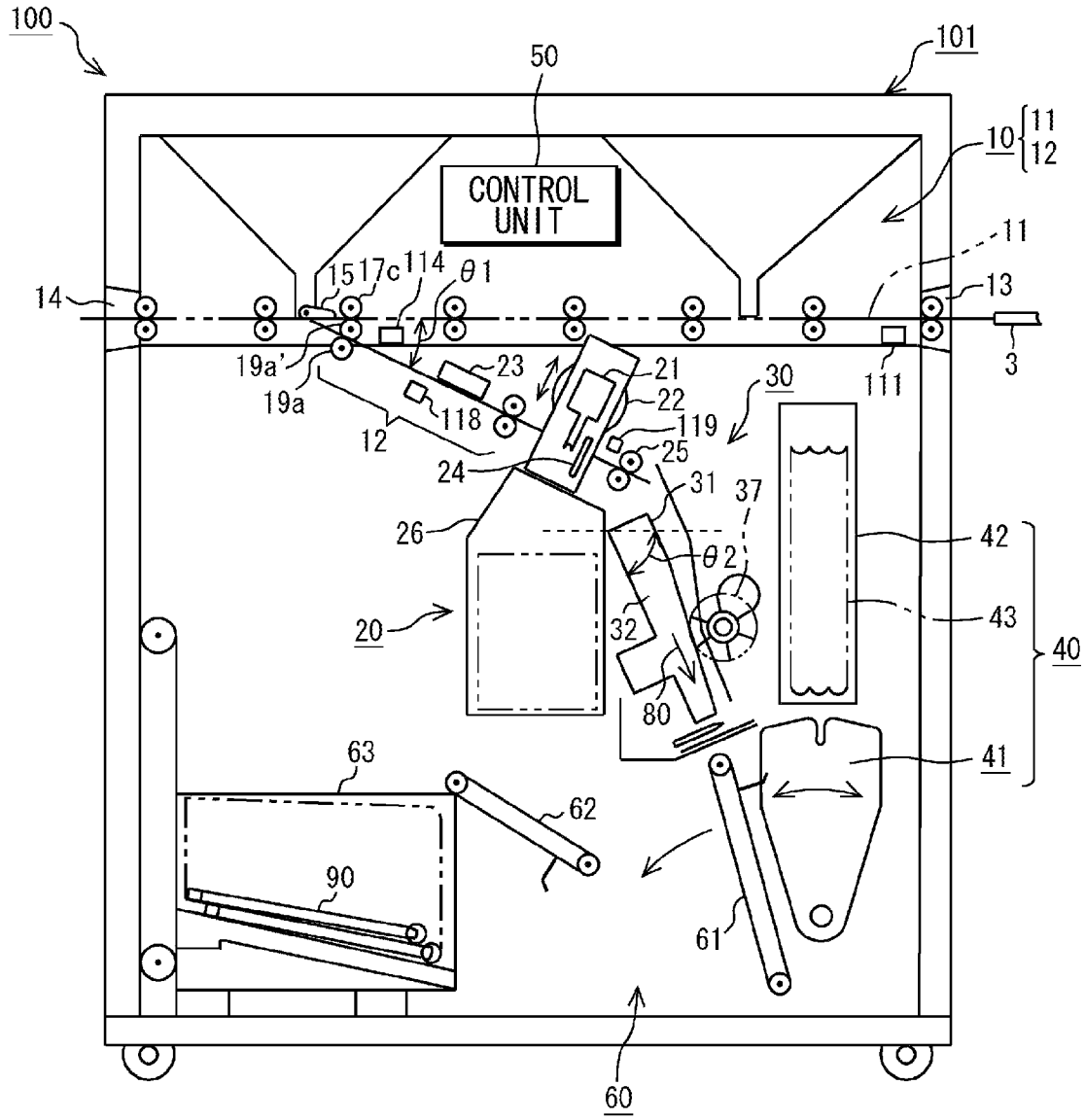
FIG. 1 is a conceptional diagram of a cross-section showing a configuration example of a binding device 100 to which a paper-sheet handling device as an embodiment according to the present invention is applied.

In this exemplified embodiment, it is performed that the binder paper alignment unit 30, the movement mechanism 41, and the binder cassette 42, which are functions of the binding device 100 shown in FIG. 1, are unitized into three; the movement mechanism 41 is made to be movable; and by arranging the binder paper alignment unit 30 and the binder cassette 42 radially centering around the movement mechanism 41, two processes of separation process of the binding component 43 and binding process by the binding component 43 are made.

The binding device 100 is a device which constitutes one example of the paper-sheet handling device, applies a punching process to a recording paper (hereinafter, merely referred to as paper-sheet 3) released from the copy machine or the printing machine and thereafter, releases the recording paper after the binding process by predetermined binding components (consumables) 43. Of course, the present invention can apply to a device provided with a function of perforating a predetermined paper-sheet 3 and releasing the paper-sheet 3 directly as it is. The binding device 100 has a device body portion (housing) 101. It is preferable for the binding device 100 to be used in conjunction with a copy machine, a printing machine (picture forming device) or the like, and the device body portion 101 has a comparable height as that of a copy machine, a printing machine or the like.

A paper-sheet transport unit 10 which constitutes one example of paper-sheet transport means is provided in a device body portion 101. The paper-sheet transport unit 10 has a first transport path 11 and a second transport path 12. The transport path 11 has a paper-feed inlet 13 and an outlet 14, and has a through-pass function for transporting the paper-sheet 3 drawn from the paper-feed inlet 13 toward the outlet 14 that becomes the predetermined position.

Here, the through-pass function means a function that the transport path 11 positioned between a copy machine, a printing machine or the like on the upstream side and other paper-sheet handling device on the downstream side directly delivers the paper-sheet 3 from the copy machine, the printing machine or the like to the other paper-sheet handling device. In a case in which the through-pass function is selected, it is configured that the acceleration process of the transport rollers, the binding process or the like is omitted. The paper-sheet 3, usually, in case of one-side copy, is delivered in a state of the face down. A paper feed sensor 111 is mounted on the paper-feed inlet 13 so as to output a paper feeding detection signal to a control unit 50 by detecting a front edge of the paper-sheet 3.

The transport path 12 has a switchback function by which the transport path is switchable from the aforesaid transport path 11. Here, the switchback function means a function that decelerates and stops the transport of the paper-sheet 3 at a predetermined position of the transport path 11, thereafter, switches the transport path of the paper-sheet 3 from the transport path 11 to the transport path 12, and also, delivers the aforesaid paper-sheet 3 in the reverse direction. A flap 15 is provided in the transport path 11 so as to switch the transport path from the transport path 11 to the transport path 12.

Also, three cooperative transport rollers 17*c*, 19*a*', 19*a* are provided at a switch point between the transport path 11 and the transport path 12. The transport rollers 17*c* and 19*a* rotate clockwise, and the transport roller 19*a*' rotates counterclockwise. For example, it is constituted such that the transport roller 19*a*' is a drive roller and the transport rollers 17*c* and 19*a* are driven rollers. The paper-sheet 3 taken by the transport rollers 17*c* and 19*a*' decelerates and stops, but when it is restricted from the upper side to the lower side by the flap 15, the paper-sheet 3 is transported to the transport path 12 by the transport rollers 19*a*' and 19*a*. A paper-sheet detecting sensor 114 is disposed just before the three cooperative transport rollers 17*c*, 19*a*' and 19*a*, and it is configured that a front end and a rear end of the paper-sheet is detected and a paper-sheet detection signal is outputted to the control unit 50.

A punching process unit 20 that becomes one example of a perforating means is arranged on the downstream side of the transport path 12. It is configured that in the punching process unit 20, two or more holes for the binding are perforated at the one end of the paper-sheet 3 which switchbacks from the transport path 11 and transported by the transport path 12. The punching process unit 20 has, for example, a motor 22 that drives a reciprocatingly operable punch blade 21. The paper-sheet 3 is perforated by the punch blade 21 driven by a motor 22 for every sheet.

An openable and closable fence 24 that becomes a reference of the perforation position is provided in the punching process unit 20 and is used so as to attach the paper-sheet 3. Further, a side jogger 23 that becomes one example of a paper-sheet posture correction means is provided in the punching process unit 20 so that the posture of the paper-sheet 3 can be corrected. For example, the front edge of the paper-sheet 3 is made to be attached uniformly to the openable and closable fence 24 that becomes one example of a positional reference means. The fence 24 becomes a positional reference at the time of aligning the paper-sheet edge portion. A paper-sheet detecting sensor 118 is disposed before the side jogger 23, and it is configured that the front end and the rear end of the paper-sheet are detected and a paper-sheet detection signal S18 is outputted to the control unit 50.

The punching process unit 20 stops the paper-sheet 3 by attaching it to the fence 24 and thereafter, perforlates the front edge of aforesaid paper-sheet 3. It should be noted that a punch scrap storing unit 26 is provided under the punching processing main body so that the punch scrap cut off by the punch blade 21 can be stored therein. A paper output roller 25 is provided on the downstream side of the punching process unit 20 and the paper-sheet 3' after the paper-sheet perforation is made so as to be transported to the unit of the succeeding stage.

The binder paper alignment unit 30 which becomes one example of the paper-sheet reserving means is arranged on the downstream side of punching process unit 20 and a plurality of paper-sheets 3' which are released from the punching process unit 20 are made so as to be reserved (stared) temporarily in a state in which the hole positions thereof are aligned. Holes are perforated at predetermined positions for each of the paper-sheets 3'. The binder paper alignment unit 30 is arranged so as to set the paper-sheet reseving surface at the position having a second depression angle θ2 by making a transport surface of a transport path 11 to be a reference. Here, the paper-sheet reserving surface means a surface that reserves (stacks) the paper-sheets 3' where the holes are perforated. In this embodiment, a relation between the depression angle θ1 and the depression angle θ2 is set as $\theta 1<\theta 2$. With respect to the depression angle θ1, it is set as $0°<\theta 1<45°$ and with respect to the depression angle θ2, it is set as $0°<\theta 2<90°$ respectively. This is set for reducing a width of the main body device body portion 101 and for linearly transporting the paper-sheets 3' under this condition.

The binder paper alignment unit 30 has a paper-sheet guide pressing mechanism 31 and a paper-sheet reserving unit 32 and guides the paper-sheets 3' to a predetermined position by the paper-sheet reserving unit 32 when the paper proceeds and after the paper proceeding is completed, it is configured that the rear end side of each of the paper-sheets 3' is immobilized. Also, the binder paper alignment unit 30 has a function of aligning the paper-sheet front edge corner portion and it is configured that when the paper proceeds, the front edge and the side edge of each of the paper-sheets 3' are aligned at standard positions.

The binder paper alignment unit 30 has a clamp movement mechanism 80. it is configured that the clamp movement mechanism 80 moves the paper-sheet guide pressing mechanism 31 which holds a bundle of paper-sheets 3" stacking the paper-sheets 3' after the paper-sheet perforation to the paper-sheet transporting direction. On the downstream side of the binder paper alignment unit 30, a binding process unit 40 is arranged and it is configured that a booklet 90 is produced by binding the bundle of the paper-sheets 3" constituted of a plurality of papers aligned by the aforesaid unit 30 using the binding component 43. The booklet 90 means a bound bundle of paper-sheets 3" in which the binding component 43 is fitted.

In this embodiment, the binding process unit 40 has the movement mechanism 41. The movement mechanism 41 moves so as to rotate reciprocatingly between the positions in the paper-sheet transporting direction of the binder paper alignment unit 30 and in a direction perpendicular to the transporting direction of the aforementioned transport path 11. The binding process unit 40 has the binder (binding component) cassette 42. In the binder cassette 42, a plurality of binding components 43 to be transferred to the movement mechanism 41 are stored (set). The binding components 43 are, for example, injection-molded and a plurality of kinds thereof is prepared corresponding to a thickness of the bundle of paper-sheets 3".

The movement mechanism 41 mentioned above, for example, pulls out one piece of binding components 43 from the binder cassette 42 at the position perpendicular to the transporting direction of the transport path 11 and holds it and in this state, the movement mechanism 41 rotates to the position from which the paper-sheet transporting direction of the binder paper alignment unit 30 can be looked over. At this position, the binding process unit 40 receives a bundle of paper-sheets 3" whose punch holes 3*a* are position-determined from the binder paper alignment unit 30 and fits the binding component 43 into the punch holes 3*a* thereof, and a binding process is executed (automatic book-making function).

A releasing unit 60 is arranged on the downstream side of the movement mechanism 41, and it is configured that a releasing processing for a booklet 90 produced by the binding process unit 40 is carried out. The releasing unit 60 is constituted so as to include, for example, a first belt unit 61, a second belt unit 62 and a stacker 63.

It is configured that the belt unit 61 receives the booklet 90 that is dropping from the binder paper alignment unit 30, and switches the delivery direction. For example, it is configured that the belt unit main body is turned around toward a predetermined release direction from the position from which the paper-sheet transporting direction of the binder paper alignment unit 30 can be looked over.

It is configured that the belt unit 62 receives the booklet 90 whose delivery direction is switched by the belt unit 61 and transports it in the relay manner. It is also configured that the stacker 63 accumulates the booklets 90 transported by the belt units 61 and 62.

Subsequently, a function example of the binding device 100 will be explained with respect to a paper-sheet handling method relating to the present invention with reference to FIG. 2.

Figure 2:
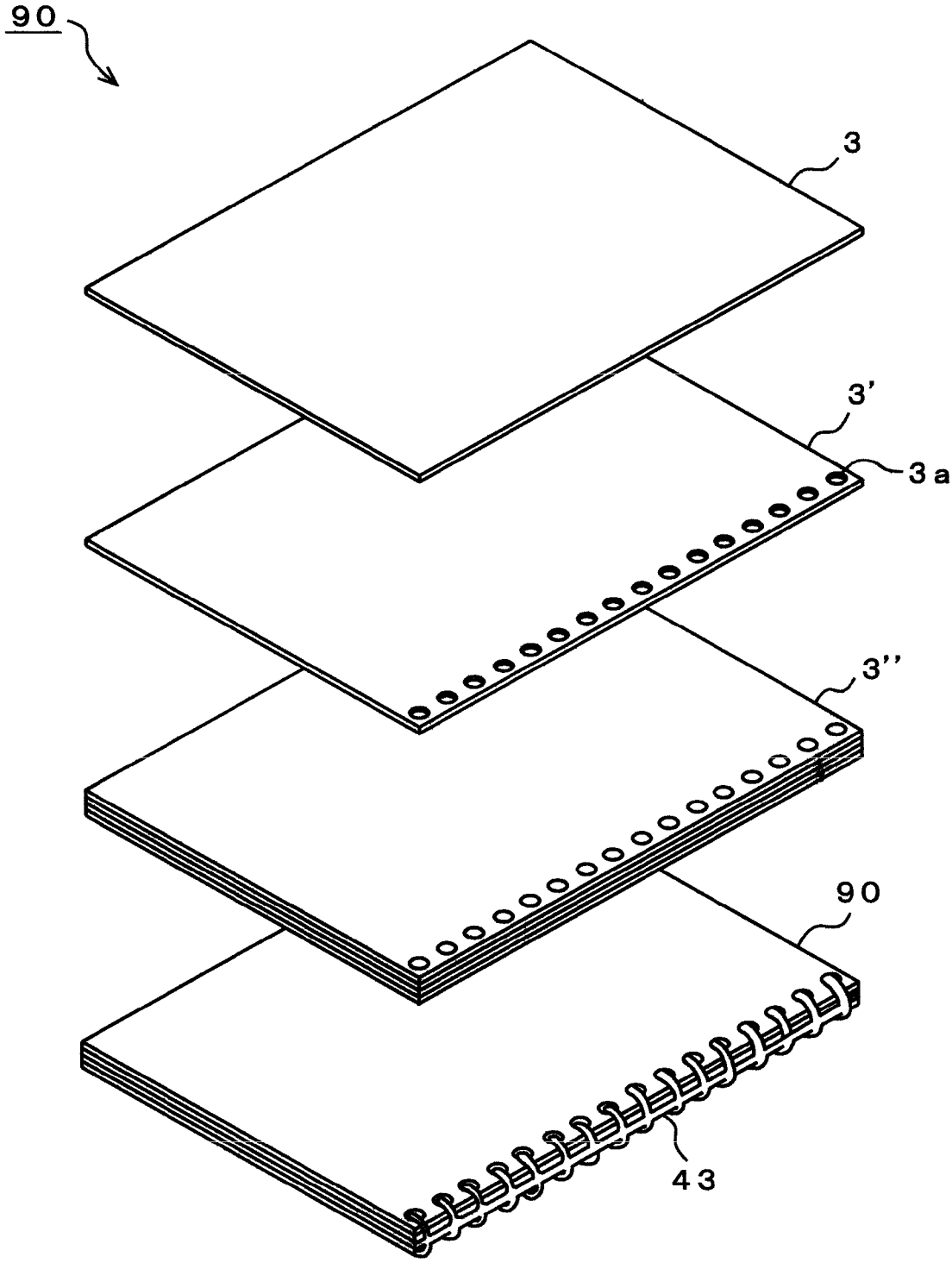
FIG. 2 is diagram showing a function example of the binding device 100.

The paper-sheet 3 shown in FIG. 2 is one which has been fed from the upstream side of the binding device 100 shown in FIG. 1. It is one for which punch holes 3*a* are not perforated. The paper-sheet 3 is transported and directed to a predetermined position of the transport path 11 shown in FIG. 1 and is decelerated and stopped at the predetermined position of the transport path 11. Thereafter, the transport path of the paper-sheet 3 is switched from the transport path 11 to the transport path 12 and also, the aforesaid paper-sheet 3 is delivered in the reverse direction and is transported to the punching process unit 20.

In the punching process unit 20, as shown in FIG. 2, a predetermined number of holes for the binding are perforated at one end of the paper-sheet 3. The paper-sheet 3' in which the holes for the binding are perforated is transported to the binder paper alignment unit 30. It is configured that when reaching a preset paper-sheet quantity, in the binder paper alignment unit 30, the positions of the holes for the binding of the bundle of paper-sheets 3" are aligned and the binding component 43 is fitted into the holes thereof under the cooperation of the binding process unit 40. Thus, it is possible to obtain the booklet 90 fitted with the binding component 43.

Figure 3:
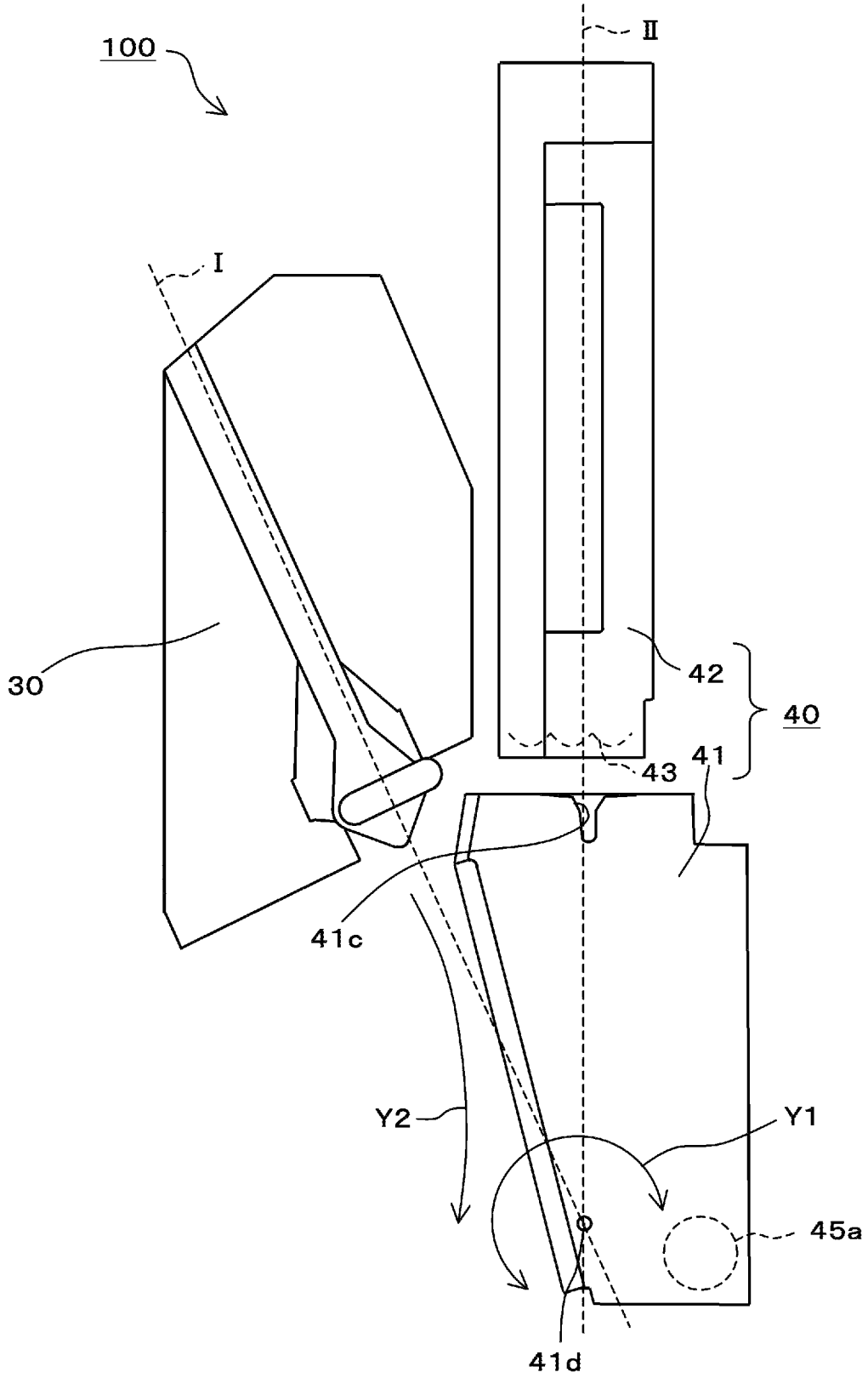
FIG. 3 is a schematic diagram showing an arrangement example of a binder paper alignment unit 30, a movement mechanism 41 and a binder cassette 42.

Subsequently, an arrangement example of the binder paper alignment unit 30, the movement mechanism 41, and the binder cassette 42 will be explained with reference to FIG. 3. In this embodiment, a case is assumed in which the binding process unit 40 shown in FIG. 3 is constituted by the movement mechanism 41 and the binder cassette 42. It is, of course, allowed to constitute the movement mechanism 41 as a binding process unit by separating the binder cassette 42 from the binding process unit 40.

The binding device 100 has an arrangement structure forming approximately a V-shape in which the movement mechanism 41 of the binding process unit 40 is arranged on the downstream side of the binder paper alignment unit 30 and the binder cassette 42 and also, the binder paper alignment unit 30 and the binder cassette 42 are arranged radially on the upstream side by making the aforesaid movement mechanism 41 to be a reference.

The movement mechanism 41 has a movement mechanism rotating axis 41*d* which becomes one example of a rotation axis. The movement mechanism rotating axis 41*d* is arranged, for example, in the vicinity of a region where a direction I in which the bundle of paper-sheets 3" is released from the binder paper alignment unit 30 to the downstream side and a direction II in which the binding component 43 is discharged from the binder cassette 42 to the downstream side are intersected.

The binder paper alignment unit 30 and the binder cassette 42 are arranged on the left side and on the right side in arc shape (radially) on the upstream side by making the movement mechanism rotating axis 41*d* to be a reference. The movement mechanism 41 operates so as to move reciprocatingly between the binder paper alignment unit 30 and the binder cassette 42.

An arrow Y1 shown in FIG. 3 indicates a rotation direction of the movement mechanism 41. In this embodiment, supposing that the binding component extraction position (direction II) is a home position by making the movement mechanism rotating axis 41*d* as a reference, it rotates from this home position to the paper-sheet binding position (direction I) counterclockwise. On the contrary, it rotates from the paper-sheet binding position to the home position clockwise. The movement mechanism 41 is provided with a motor 45*a* and a motor control signal S40 is outputted to this motor 45*a* from the control unit 50 shown in FIG. 20 and thus, the motor drive control is performed.

For example, in the binding process unit 40, it is configured that the movement mechanism 41 moves to the downstream side of the binder cassette 42, receives a binding component 43 of a predetermined size, holds the binding component 43 received from the binder cassette 42, moves to the downstream side of the binder paper alignment unit 30 by rotating counterclockwise (from right side to left side) by making the rotation axis position to be a reference, and the bundle of paper-sheets 3" are bound by means of the aforesaid binding component 43. If doing so, it is possible to produce the booklet 90 by moving the binding component 43 received from the binder cassette 42 to the downstream side of the binder paper alignment unit 30 and by performing the binding process.

In this embodiment, the binding process unit 40 receives the binding component 43 from the binder cassette 42 while the binder paper alignment unit 30 is aligning the paper-sheets 3'. If doing so, the paper-sheet aligning process and a process for receiving the binding component 43 can be processed in parallel, so that it is possible to attempt speeding up of the binding process and the throughput of the aforesaid binding device 100 is improved.

Also, the movement mechanism 41 has an opening portion 41*c* for the positioning at the upper portion of its main body. It is configured that the opening portion 41*c* is inserted with a lock member, which is not shown, in case of receiving the binding component 43 from the binder cassette 42 and in a case in which the bundle of paper-sheets 3" is binding-processed by the binder paper alignment unit 30. The above-mentioned binding component extraction position is a position when the opening portion 41*c* of the movement mechanism 41 takes a posture facing a side of the binder cassette 42.

In this embodiment, when the movement mechanism 41 moves to a position where the binding component 43 is received from the binder cassette 42, the booklet through-pass path Y2 is defined to the direction of releasing the bundle of paper-sheets from the binder paper alignment unit 30 to the downstream side. The booklet through-pass path Y2 is a partial space region which the movement mechanism 41 has occupied until the movement mechanism 41 located at the paper-sheet binding position has returned to the binding component extraction position. If doing so, it is possible to release the booklet 90 from the binder paper alignment unit 30 while the binding process unit 40 receives the binding component 43, thereby enabling speeding up of the binding process to be realized so that the throughput of the aforesaid binding device 100 can be improved.

Figure 4:
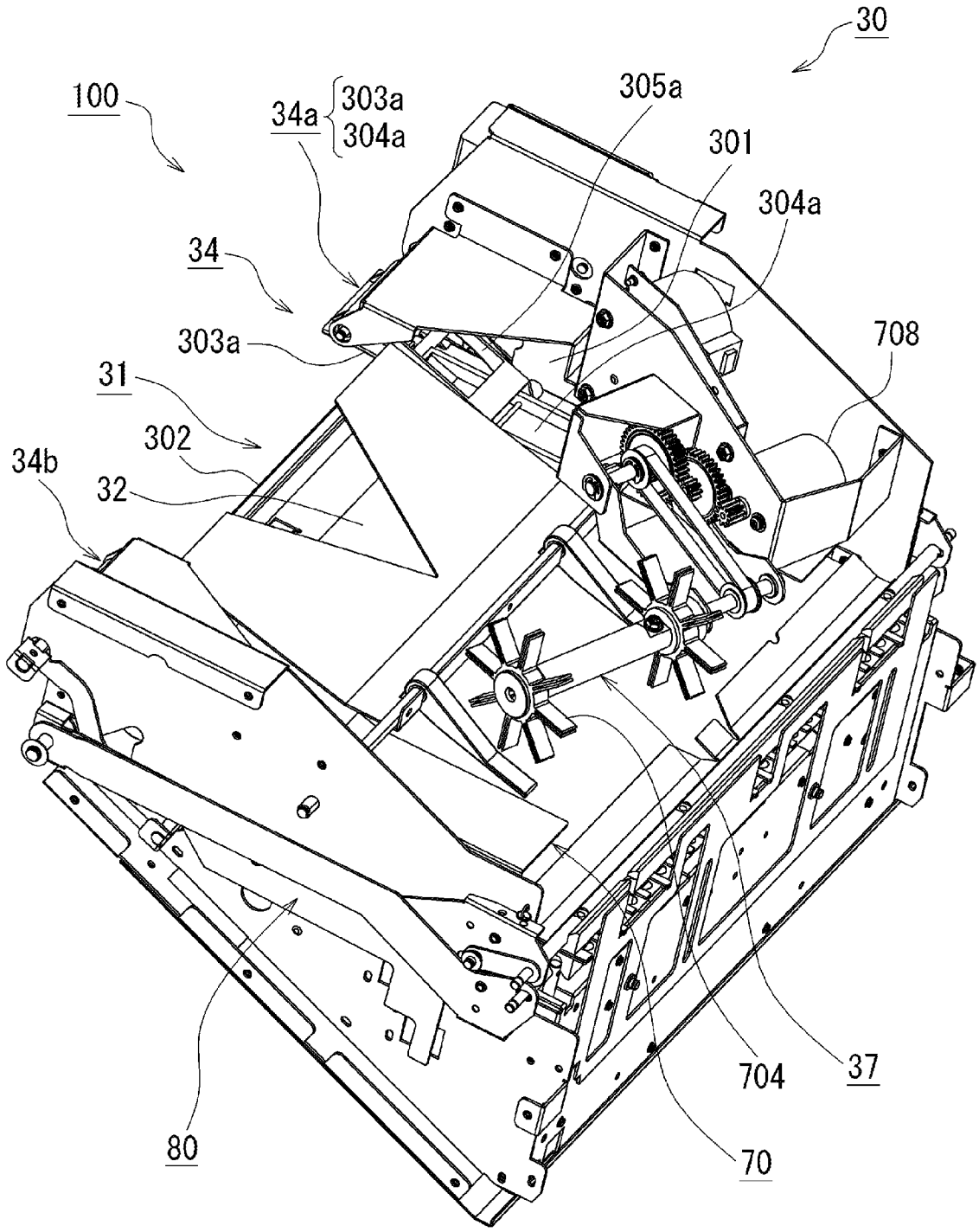
FIG. 4 is a perspective view showing a configuration example of the binder paper alignment unit 30.

Subsequently, a constitution example of the binder paper alignment unit 30 will be explained with reference to FIG. 4. The binder paper alignment unit 30 shown in FIG. 4 is a unit which aligns and temporarily reserves the paper-sheet 3' transported by the paper-sheet transport unit 10.

The binder paper alignment unit 30 has a paper-sheet guide pressing mechanism 31. It is configured that the paper-sheet guide pressing mechanism 31 guides the paper-sheet 3' to a predetermined position when the paper proceeds and after the paper proceeding is completed, the rear end side of the paper-sheet 3' is immobilized, for example, at the time of the binding processing.

The paper-sheet guide pressing mechanism 31 is constituted by including, for example, a paper-sheet reserving unit 32 and right/left rotatable guide portions 34*a* and 34*b*. The paper-sheet reserving unit 32 is a unit which stores and temporarily reserves the paper-sheet 3'.

The rotatable guide portion 34*a* constitutes one example of the guide member and operates such that one side thereof guides the paper-sheet 3' to the paper-sheet reserving unit 32 when the paper-sheet proceeds and the paper-sheet 3' is to be immobilized after the paper proceeding is completed. The rotatable guide portion 34*a* is constituted by including, for example, a solenoid 301, a connecting rod 302, a guide frame 303*a*, a pressing member 304*a*, and a link mechanism 305*a*.

The rotatable guide portion 34*b* operates such that the other side thereof guides the paper-sheet 3' to the paper-sheet reserving unit 32 when the paper-sheet proceeds and the paper-sheet 3' is to be immobilized after the paper proceeding is completed. The rotatable guide portion 34*b* is constituted by including, for example, a guide frame 303*b*, a pressing member 304*b* and a link mechanism 305*b* although they are not shown.

A pair of link mechanisms 305*a*, 305*b* (which is not shown) is arranged on the right and left sides of the paper-sheet reserving unit 32. The link mechanisms to 305*a*, 305*b* are engaged freely rotatably by the connecting rod 302. For example, the solenoid 301 is mounted on the one link mechanism 305*a*. The solenoid 301 is mounted on the paper-sheet reserving unit main body.

It is configured in this embodiment that the reciprocating movement of the solenoid 301 is transmitted to the right and left link mechanisms to 305*a*, 305*b*. The guide frame 303*a* is attached to the link mechanism 305*a* and the guide frame 303*b* is attached to the link mechanism 305*b*. It is configured that the respective guide frames 303*a*, 303*b* have R-curve (R-shape) projecting toward the upper direction from the paper surface of the paper-sheet 3', which guides the paper-sheet 3' to the paper-sheet reserving unit 32. It is configured that the solenoid 301 mentioned above drives the guide frames 303*a*, 303*b* through the right and left link mechanisms 305*a*, 305*b* to activate the pressing member 304*a*, 304*b* (which is not shown).

The pressing member 304*a* is rotatably attached to a front edge of the guide frame 303*a* and operates so as to immobilize the paper-sheet 3' after the paper proceeding is completed. The pressing member 304*a* is, for example, an injection molded component by resin and the bottom region thereof has a flat shape. The size thereof is 20 mm to 30 mm in width and around 60 mm to 80 mm in length. The thickness thereof is around 8 mm to 10 mm.

When, for example, the paper-sheet proceeds, the pressing member 304*a* is constituted so as to become an extended guide of a moving guide shape which was formed by the rotatable guide portion 34*a* and the pressing member 304*a* is always biased by a biasing member in an open state of the immobilizing function by the aforesaid pressing member 304*a* so as to become a moving guide shape of a mode cooperating with the moving guide shape by the rotatable guide portion 34*a*. The pressing member 304*a* has such a structure that the pressing member 304*a* is touched to the paper-sheet 3' with tracing it after the paper proceeding is completed and holds down the aforesaid paper-sheet 3' by a flat surface thereof. Although it is not shown, also the guide frame 303*b* and the pressing member 304*b* are constituted similarly.

The binder paper alignment unit 30 has an alignment function of the paper-sheet front edge corner portion other than the paper-sheet guide pressing mechanism 31 and is configured, when the paper proceeds, so as to guide the front edge of the paper-sheet 3' to a proper position of a multiple-paddle shaped rotating member (hereinafter, referred to as paddle roller unit 37) for aligning the front edge and the side edge of the paper-sheet 3' at a reference position. The paddle roller unit 37 has a multiple fin structure in which a plurality of fins 704 having predetermined thickness and also predetermined elasticity are constituted in a ring shape.

The side jogger 70 and the clamp movement mechanism 80 are provided on the downstream side of the paddle roller unit 37. It is configured that for a pretreatment of binding the binding component 43 at the holes of the bundle of paper-sheets 3", the side jogger 70 carries out paper alignment by applying vibration from the both sides of the bundle of paper-sheets 3" and the positions of the holes are aligned. It is configured that at that moment, alignment pins, which are not shown, are inserted into the holes of the bundle of paper-sheets 3". It is configured that the clamp movement mechanism 80 moves the bundle of paper-sheets 3" stacked with the paper-sheets 3' after the perforation a little bit from the paper-sheet guide pressing mechanism 31 to the upstream side along the paper-sheet transporting direction (the direction I in FIG. 3).

Subsequently, a configuration example of the clamp movement mechanism 80 in the binder paper alignment unit 30 will be explained with reference to FIG. 5 and FIG. 6. It is configured that the clamp movement mechanism 80 shown in FIG. 5 fixes the edge portion of the bundle of paper-sheets 3" on the hole side thereof and moves a little bit from the paper-sheet guide pressing mechanism 31 to the downstream side along the paper-sheet transporting direction.

The clamp movement mechanism 80 is constituted by including a main body substrate 81, clamp members 82*a*, 82*b*, a shutter 83, comb shaped pressing members 84*a*, 84*b* (which is not shown), alignment pins 85*a*, 85*b*, a motor 86, cams 87*a*, 87*b*, and a gear unit 88.

The main body substrate 81 is constituted by including a front surface region and side surface regions. The main body substrate 81 is formed with a front surface region and right/left side surface regions by bend-processing an iron plate. The left side surface region occupies a larger region than that of the right side surface region. In this embodiment, a motor mounting region is provided inside the left side surface region, a mounting region of the clamp members 82*a* is provided on the upper side of the right side surface region, and a mounting region of the clamp member 82*b* is provided on the upper side of the left side surface region, respectively. The clamp members 82*a*, 82*b*, the shutter 83, the comb shaped pressing member 84*a*, 84*b*, the alignment pins 85, the motor 86, the cams 87*a*, 87*b* and the gear unit 88 are, respectively, arranged on the main body substrate 81.

The clamp members 82*a*, 82*b* are movably mounted at the upper portions on the both side edges of the main body substrate 81 and they operate so as to hold and fix the bundle of paper-sheets 3" or so as to release it in a free state. The clamp member 82*a* on the right edge side is constituted by including, for example, a clip-shaped member 801 and a member 802 with a restriction hole, which has a sword-tip shape at the front edge.

The clip-shaped member 801 is constituted by including a pair of movable members 801*a*, 801*b*. A first connecting rod 803 is movably mounted on one terminal of the one movable member 801*a*. A second connecting rod 804 is movably mounted on one terminal of the other movable member 801*b*. The other edges of the (pair of) movable members 801*a*, 801*b* are rotatably engaged on a fulcrum axis member 805 together with the other edge of the member 802 with a restriction hole.

The member 802 with a restriction hole has an elongated opening portion 806 for clamp open-close restriction which restricts the movements of the first connecting rod 803 and the second connecting rod 804. The first connecting rod 803 and the second connecting rod 804 are assembled so as to expose their edge portions at the opening portion 806.

Figure 6A:
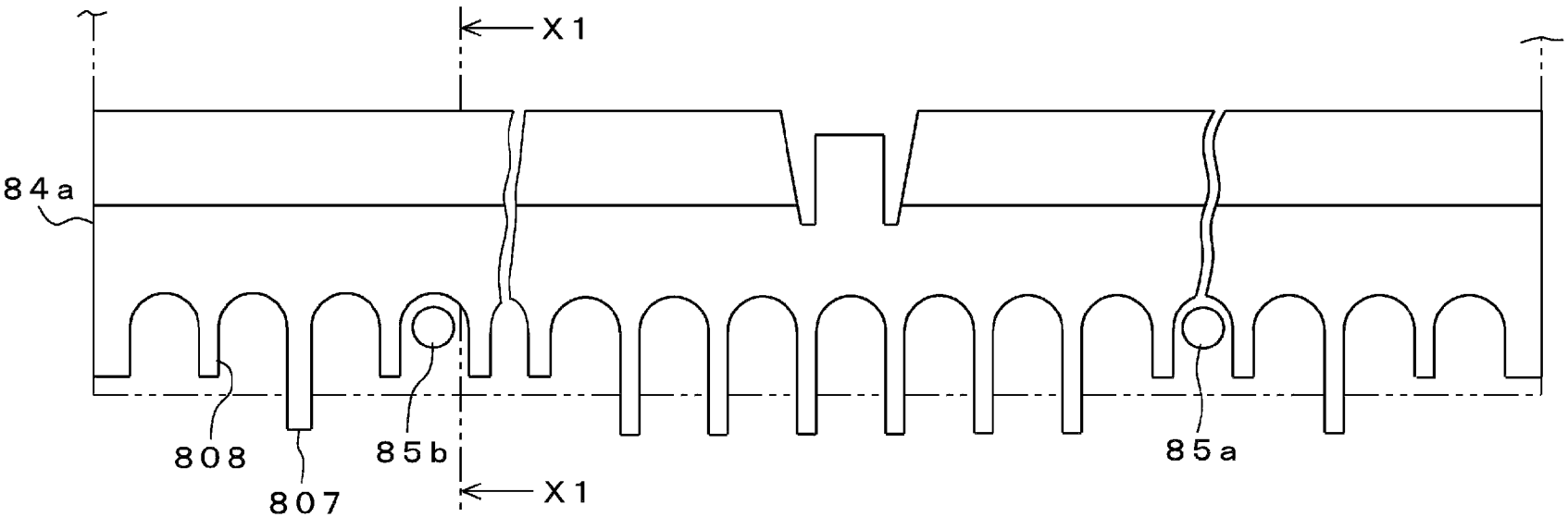
FIG. 6A is a top view showing a configuration example of comb-shaped pressing members 84*a*üC84*b*.

The comb shaped upper portion pressing member 84*a* as shown in FIG. 6A is mounted on the second connecting rod 804 and a comb shaped lower portion pressing member 84*b* is mounted on the first connecting rod 803. The comb shaped upper portion pressing member 84*a* has comb-tooth regions cut out in a U-shape. The arrangement pitch of the comb-tooth regions is made to be equal to the arrangement pitch of the punch holes 3*a* of the bundle of paper-sheets 3".

The comb-shaped portions are formed by intermingling a long-tooth region 807 with a short-tooth region 808. The long-tooth region 807 is arranged so as to protrude ahead compared with the paper edge portion of the bundle of paper-sheets 3" and the short-tooth region 808 is arranged so as to withhold on the near side compared with the paper edge portion of the bundle of paper-sheets 3". This is because by fitting the long-tooth region 807 with the region selectively opened at the shutter 83, the holding and fixing accuracy of the upper portion pressing member 84*a* and the lower portion pressing member 84*b* is improved and the closing function of the shutter is also improved.

The clamp member 82*b* on the left edge side is formed similarly as that on the right edge side, so that the explanation thereof will be omitted. The clamp member 82*b* on the left edge side and the clamp member 82*a* on the right edge side are rotatably engaged on the fulcrum axis member 805 at the rear end of the clamp movement mechanism 80 shown in FIG. 5 and at the same time, at the front end, the connecting rods 803, 804 mounted on the clip-shaped members 801 are movably engaged with the member 802 with a restriction hole. This enables a clamp mechanism to be constituted.

Figure 5:
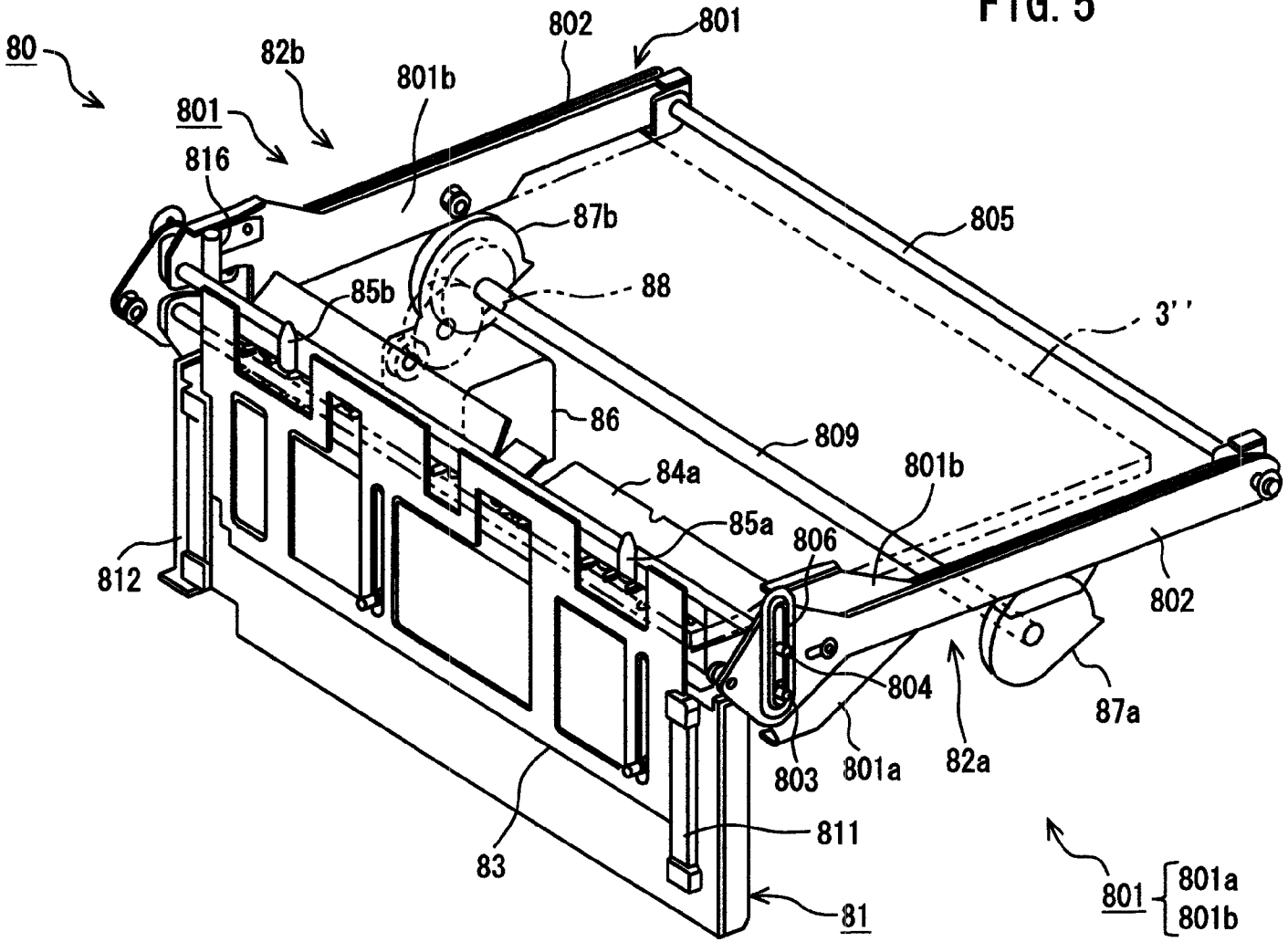
FIG. 5 is a perspective view showing a configuration example of a clamp movement mechanism 80 in the binder paper alignment unit 30.

Also, the clamp members 82*a*, 82*b* shown in FIG. 5 have such a structure that the bundle of paper-sheets 3" moves along the paper-sheet transporting direction with respect to the main body substrate 81 with holding the bundle of paper-sheets 3". Thus, it is made such that the clamp movement mechanism 80 is to be constituted.

The motor 86 is mounted in a motor mounting region provided inside the left side surface region. It is configured that the motor 86 is engaged with the gear unit 88, the motor rotational frequency is converted by a predetermined gear ratio, and the motor rotational force is transmitted to the cams 87*a* and 87*b*. The gear unit 88 is mounted with the one cam 87*b*. The cam 87*b* is mounted on the other cam 87*a* through a cam cooperative member 809. The aforementioned movable member 801*a* or 801*b* includes a cam operative region. It is configured that in each of the clamp members 82*a* and 82*b*, the clip-shaped member 801 of each of the clamp members 82*a* and 82*b* open and close synchronously by depressing the cams 87*a*, 87*b* at the cam operative region of the movable member 801*a* or 801*b*.

It should be noted that the shutter 83 is movably mounted on the front face of the main body substrate 81 and operates so as to limit the release of the bundle of paper-sheets 3" stored in the paper-sheet reserving unit 32. It is configured that the shutter 83 is driven up and down in the direction perpendicular to the transporting direction of the bundle of paper-sheets 3". It is configured that sliding members 811, 812 are provided on both sides of the shutter 83 and the shutter 83 slides along the sliding members 811, 812. In this embodiment, when the clamp members 82*a*, 82*b* make the bundle of paper-sheets 32 to be in a freely open state, it is possible to stop the natural drop of the bundle of paper-sheets 3" by closing the shutter 83.

The shutter 83 is mounted, for example, on a driving axis 816. This driving axis 816 is mounted, for example, with a solenoid, which is not shown, and it is configured that the shutter 83 opens and closes by the reciprocating movement thereof. Of course, it is not limited to this and the shutter 83 can open and close by converting a rotational movement of the motor, which is not shown, to a reciprocating movement thereof.

Figure 6B:
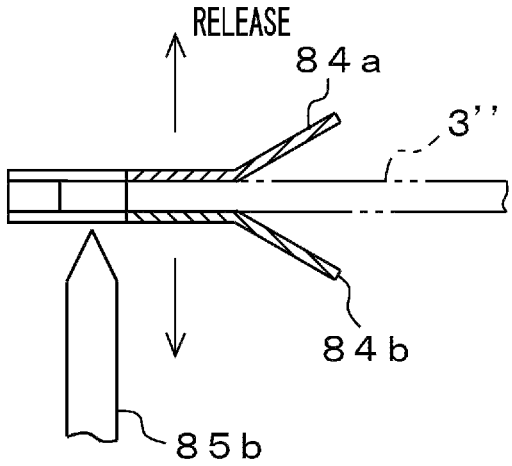
FIG. 6B is a cross-section diagram seen from X1-X1 arrows showing a configuration example before the insertion of the alignment pin thereof.

Also, the alignment pins 85*a*, 85*b* are movably mounted inside the front surface region of the main body substrate 81 and it is configured that by fitting the alignment pins 85*a*, 85*b* into the punch holes 3*a* of the bundle of paper-sheets 3" before the binding process, the positions thereof are aligned. The front edges of respective alignment pins 85*a*, 85*b* have conical shapes. For example, the bundle of paper-sheets 3ü*h* is made to be sandwiched and held between the upper portion pressing member 84*a* and the lower portion pressing member 84*b* before inserting the alignment pins 85*a*, 85*b* as shown in FIG. 6B.

Figure 6C:
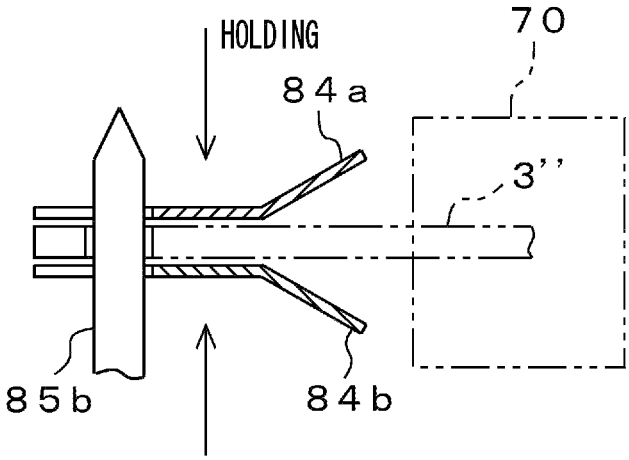
FIG. 6C is a cross-section diagram seen from X1-X1 arrows showing a configuration example after the insertion of the alignment pin.

Thereafter, the clamp members 82*a*, 82*b* are released in a state in which the shutter 83 is closed in order to align the positions of the holes of the bundle of paper-sheets 3" by the alignment pins 85*a*, 85*b*. Thereafter, the alignment pin 85*b* and the like are inserted into the holes of the bundle of paper-sheets 3" as shown in FIG. 6C. At that time, it is configured that the side jogger 70 shown by the chain double-dashed line swings both sides of the bundle of paper-sheets 3" and makes it easy to insert the alignment pins 85*a*, 85*b* and also, the hole positions of the bundle of paper-sheets 3" are aligned. This is for making it easy to insert the binding component 43. The main body substrate 81 mounted with these members is mounted on the main body portion of the binder paper alignment unit.

Figure 7:
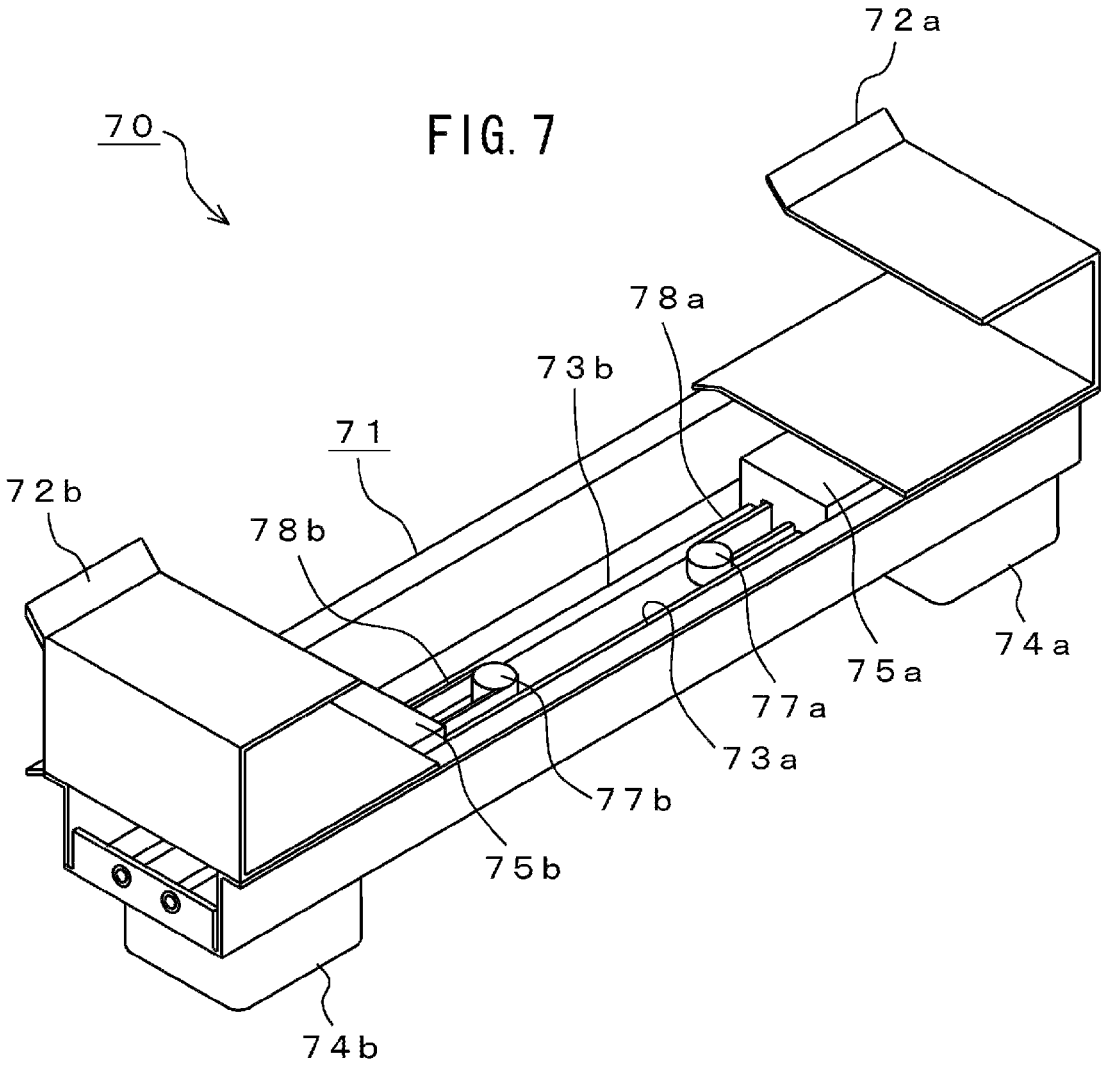
FIG. 7 is a perspective view showing a configuration example of a side jogger 70.
Figure 8:
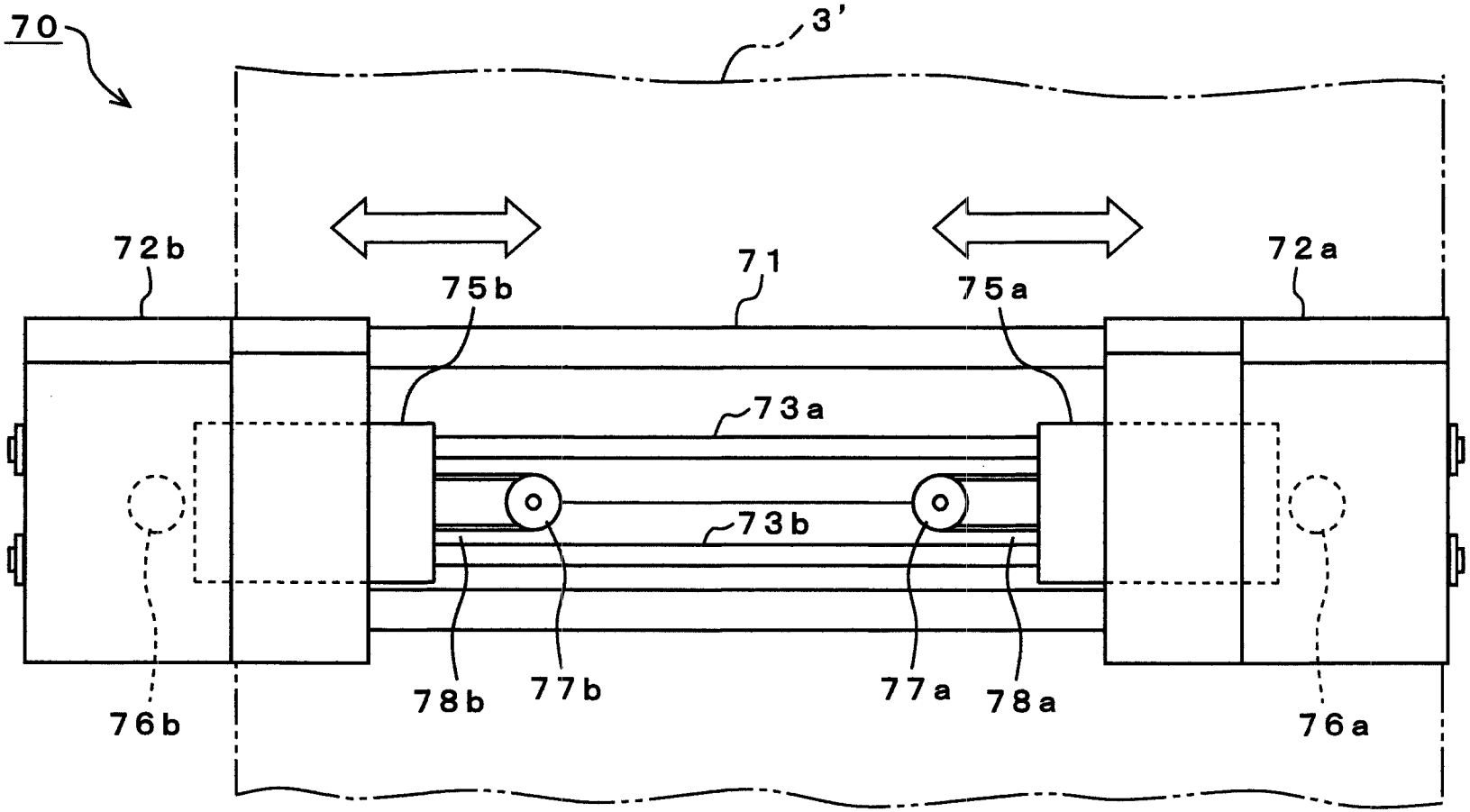
FIG. 8 is a diagram showing a configuration example of the side jogger 70 seen from the upper surface.

Subsequently, a configuration example of the side jogger 70 will be explained with reference to FIG. 7 and FIG. 8. The side jogger 70 shown in FIG. 7 is provided in the binder paper alignment unit 30 shown in FIG. 4. The side jogger 70 is constituted by including a main body housing portion 71, paper gathering members 72*a*, 72*b*, rails 73*a*, 73*b*, motors 74*a*, 74*b* and movement stages 75*a*, 75*b*.

The main body housing portion 71 is constituted by including an upper surface region and a back surface region. The main body housing portion 71 is formed as a box-shaped body by performing any bend-processing on an iron plate. The upper surface region of the box-shaped body is opened. In this embodiment, the back surface region of the main body housing portion 71 is made to be a motor mounting region. The upper surface region thereof is made to be a movement stage region.

The paper gathering members 72*a*, 72*b*, the rails 73*a*, 73*b*, and the movement stages 75*a*, 75*b* are arranged in the movement stage region. For example, the rails 73*a*, 73*b* are located between both the wall surfaces in the inside of the main body housing portion 71 so as to make bridges therebetween. The rails 73*a*, 73*b* are mounted such that two round bars are fixed at the positions at which the right side edge and the left side edge of the main body housing portion 71 are pierced. These rails 73*a*, 73*b* are engaged with one set of movement stages 75*a*, 75*b* freely movably in the right and left directions.

The movement stages 75*a*, 75*b* are constituted, for example, by injection molded components and these movement stages 75*a*, 75*b* are provided with such opening portions (which is not shown) that pierce the right and the left, and the rails 73*a*, 73*b* are passed through these opening portions. Of course, it is not limited to the mode of passing the rails 73*a*, 73*b* through the opening portions and a mode of traveling on the rails 73*a*, 73*b* by mounting driving wheels on the movement stages 75*a*, 75*b* may be employed.

The paper gathering members 72*a*, 72*b* for the left edge and for the right edge are mounted at the upper portions of the movement stages 75*a*, 75*b*. For each of the paper gathering members 72*a*, 72*b*, a member obtained, for example, by performing any bend-processing on an iron plate in U-shape is used. On the upstream sides of the paper gathering members 72*a*, 72*b*, the upper edge portions have flipped-up shapes (flaps) for the paper guide and also, the lower edge portions have drooping shapes conversely. These shapes are provided for guiding the paper-sheet 3' delivered from the punching process unit 20 to the clamp movement mechanism 80 in cooperation with the paddle roller unit 37.

Also, motors 74*a*, 74*b* are mounted in the motor mounting region provided in the back surface region of the main body housing portion 71. Stepping motors are used for the motors 74*a*, 74*b*, respectively. The motors 74*a*, 74*b* are provided with motor rotating axes thereof passing through from the back surface region of the main body housing portion 71 to the upper surface region thereof. A pulley 76*a* for belt drive is mounted on the motor rotating axis of the motor 74*a* and a pulley 76*b* for belt drive is mounted on the motor rotating axis of the motor 74*b* (see FIG. 9).

Pulleys 77*a*, 77*b* for being driven are mounted on the upper surface region side of the main body housing portion 71. A non-terminal shaped belt 78*a* is engaged between the pulley 76*a* for belt drive and the pulley 77*a* for being driven. Similarly, a non-terminal shaped belt 78*b* is engaged between the pulley 76*b* for belt drive and the pulley 77*b* for being driven.

In this embodiment, the belts 78*a*, 78*b* are constrained by the movement stages 75*a*, 75*b*, respectively, on a going direction. The belts 78*a*, 78*b* are made to be in free states, respectively, with respect to the movement stages 75*a*, 75*b*, on a returning direction. The side jogger 70 is constituted by these members.

Although a case in which the motors 74*a*, 74*b* are provided by being mutually separated on both sides in the back surface region of the main body housing portion 71 has explained in the above-mentioned example, it is not limited to this and the motors 74*a*, 74*b* can be mounted by being gathered each other at the positions of the pulleys 77*a*, 77*b* for being driven and in the back surface region thereof and in addition, the only one motor 74*a* or 74*b* can be mounted at the position of the pulley 77*a* or 77*b* for being driven and in the back surface region thereof. In this manner, if the arrangement of the motors 74*a*, 74*b* are devised, it is possible to secure a space for the component mounting and it is possible to attempt miniaturization of the binding device 100.

Figure 9:
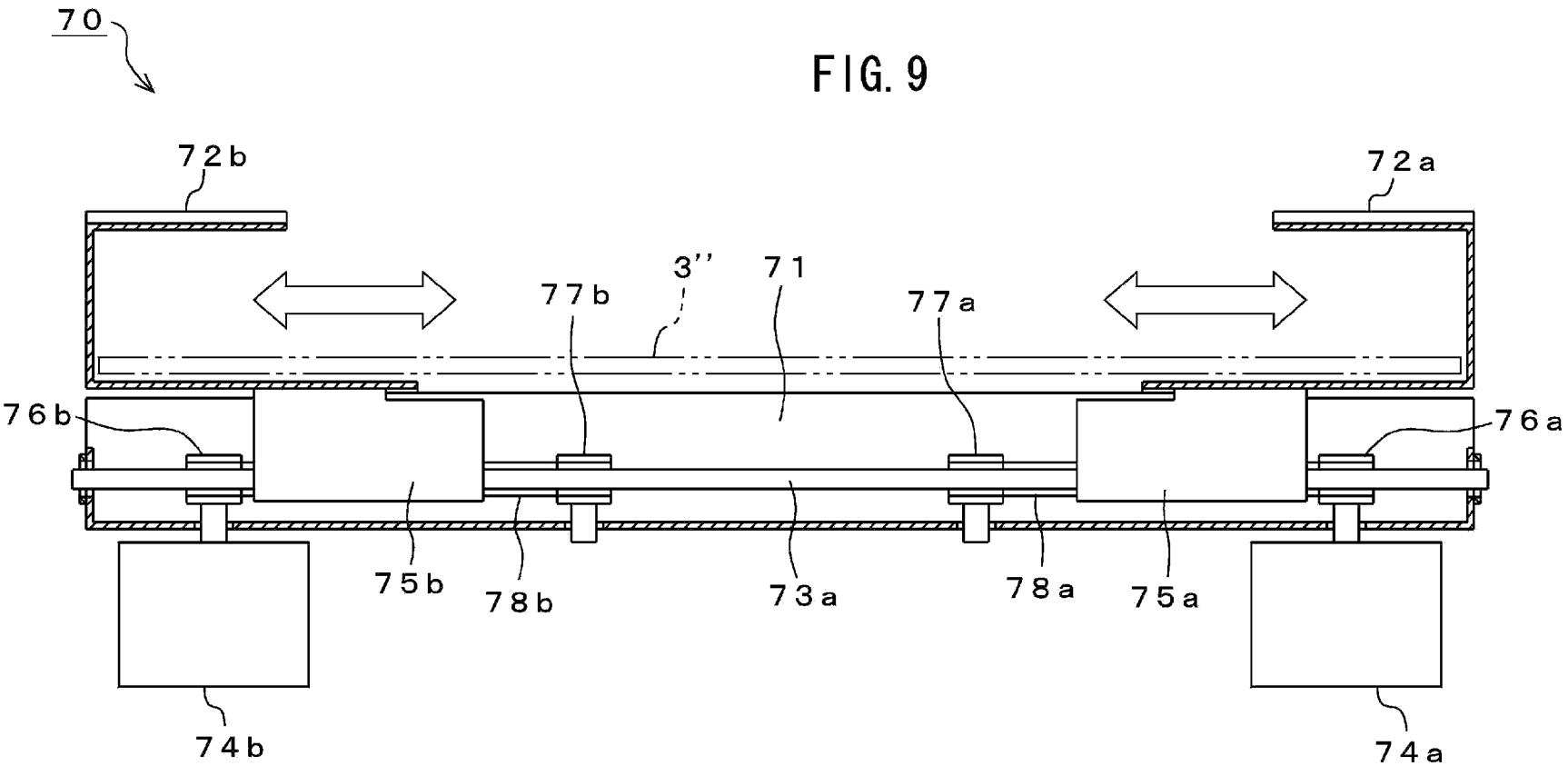
FIG. 9 is a front elevational view of a partial cross-section showing an operation example of the side jogger 70.

Subsequently, an operation example of the side jogger 70 will be explained with reference to FIG. 9. According to the side jogger 70 shown in FIG. 9, if, for example, the belts 78*a*, 78*b* as shown in FIG. 8 are operated reciprocatingly by the normal rotation and the reverse rotation of the motors 74*a*, 74*b*, it is possible to move the movement stages 75*a*, 75*b* shown in FIG. 9 which are fixed at the belts 78*a*, 78*b* to the right and left direction individually on the going direction.

It becomes possible owing to the right and left movement of these movement stages 75*a*, 75*b* to vibrate the paper gathering members 72*a*, 72*b* individually and independently on the right and left sides. When the number of steps of the motors 74*a*, 74*b* is controlled, it becomes possible to select the swing position in conformity with the width of the paper-sheet 3'. For example, even if the paper-sheet width is different between the A4-sized paper-sheet 3' and the B5-sized paper-sheet 3', it becomes possible to change the swing position by changing the number of steps of the motor of the A4-sized paper-sheet width to the number of steps of the motor of the B5-sized paper-sheet width.

Thus, just before binding the binding component 43 at the bundle of paper-sheets 3", it becomes possible at the positions shown in FIGS. 6A to 6C to insert the alignment pins 85*a*, 85*b* by swinging both sides of the bundle of paper-sheets 3" and to hold the bundle of paper-sheets 3" once again in a state in which the hole positions thereof are aligned.

Subsequently, an operation example at the time of alignment of a bundle of paper-sheets in the clamp movement mechanism 80 will be explained with reference to FIGS. 10 to 12. A case is assumed in this embodiment in which the shutter 83 is closed and the paper-sheets 3' are stored in the paper-sheet reserving unit 32. This is a standby state in which the alignment pin 85*a* is not inserted into the bundle of paper-sheets 3".

Figure 10:
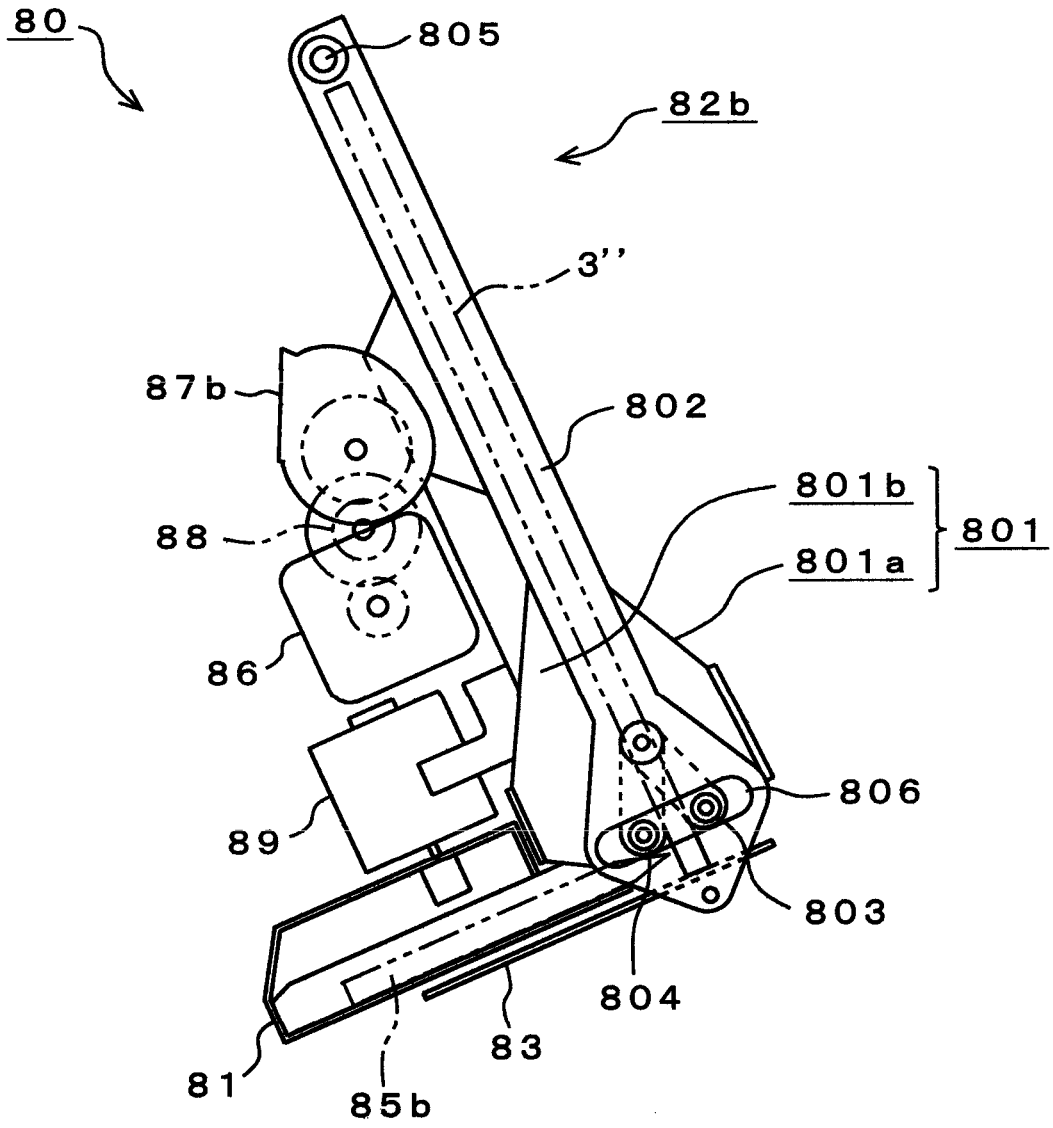
FIG. 10 is a front elevational view showing an operation example (No. 1 thereof) at the time of alignment of a bundle of paper-sheets in the clamp movement mechanism 80.

According to the operation example at the time of alignment of the bundle of paper-sheets in the clamp movement mechanism 80 shown in FIG. 10, the clamp operation is executed with the clamp member 82*b* and the clamp member 82*a* shown in FIG. 5 being restricted at the rear ends thereof by making the fulcrum axis member 805 to be a reference and with the connecting rods 803, 804 mounted on the clip-shaped members 801 as shown in FIG. 10 being restricted by the member 802 with a restriction hole at the front ends thereof.

In this embodiment, the comb shaped upper portion pressing member 84*a* mounted on the connecting rod 804 shown in FIG. 5 and the comb shaped lower portion pressing member 84*b* mounted on the connecting rod 803 hold the bundle of paper-sheets 3". At that time, it is configured that the long-tooth region 807 shown in FIG. 6A sandwiches the bundle of paper-sheets 3" at the position protruding ahead compared with the paper edge portion thereof and the short-tooth region 808 sandwiches the bundle of paper-sheets 3" at the position withholding on the near side compared with the paper edge portion thereof. Also, it is possible to improve holding and fixing accuracy of the upper portion pressing member 84*a* and the lower portion pressing member 84*b* and closing accuracy of the shutter 83 depending on a fact that the long-tooth region 807 is disposed in the opening region of the shutter 83.

At that time, the cams 87*a* and 87*b* take a predetermined posture at a first position (home position). For example, it is a state in which the protrusion portions of the cams 87*a* and 87*b* are directed just upward. It should be noted that the motor 89 in the drawing is a motor for driving the alignment pin. The motor 89 and the alignment pins 85*a*, 85*b* are engaged by a link mechanism, which is not shown. The link mechanism functions so as to convert rotational movement of the motor 89 to reciprocating movement.

Figure 11:
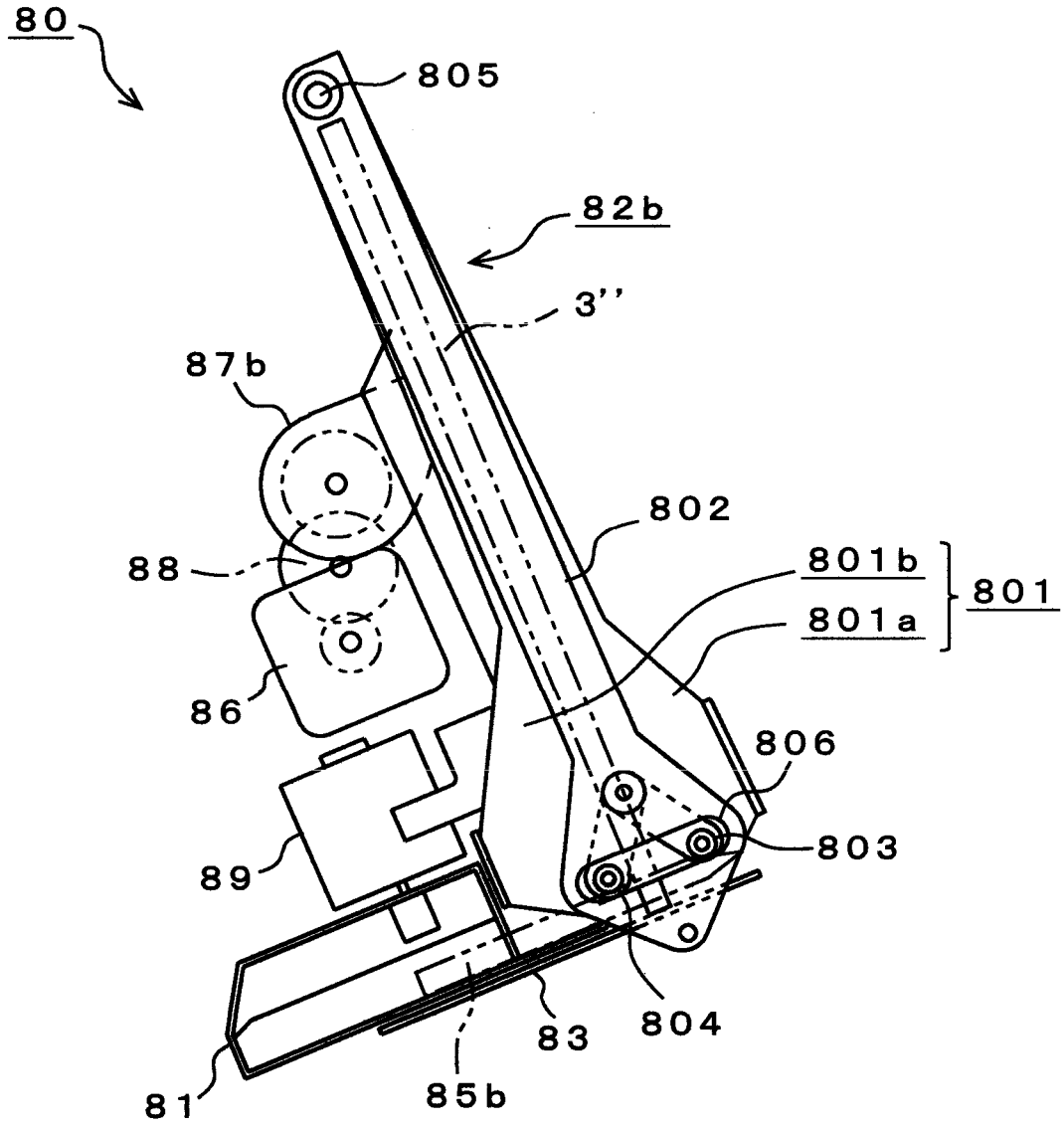
FIG. 11 is a front elevational view showing an operation example (No. 2 thereof) at the time of alignment of a bundle of paper-sheets in the clamp movement mechanism 80.

In this embodiment, the clamp members 82*a*, 82*b* are released in a state in which the shutter 83 is closed in order to align the positions of the punch holes 3*a* of the bundle of paper-sheets 3" shown in FIG. 11 and thereafter, the alignment pins 85*a*, 85*b* are inserted.

In the clamp movement mechanism 80, the cams 87*a* and 87*b* take a predetermined posture at a second position (clamp release). For example, the motor 86 converts the motor rotational frequency by a predetermined gear ratio through the gear unit 88 and transmits the motor rotational force to the cams 87*a* and 87*b*. As a result thereof, the cams 87*a* and 87*b* become in a state of rotating clockwise by 90° from the first position.

At that time, it is configured that owing to a fact in each of the clamp members 82*a* and 82*b* that the protrusion portions of the cams 87*a* and 87*b* are depressed on the cam operative region of the movable member 801*a* or 801*b*, the clip-shaped members 801 of the respective clamp members 82*a* and 82*b* open synchronously.

In the clip-shaped member 801, the movable member 801*a* and the movable member 801*b* operate so as to open by making the fulcrum axis member 805 to be a movable reference. The movable members 801*a*, 801*b* are restricted in movement by the elongated opening portion 806 of the member 802 with a restriction hole and the clamp open width of the clip-shaped member 801 is restricted. The driving force is transmitted to the connecting rod 804 mounted movably on the movable member 801*a* and the connecting rod 803 mounted movably on the movable member 801*b*.

As a result thereof, the comb shaped upper portion pressing member 84*a* mounted on the connecting rod 804 and the comb shaped lower portion pressing member 84*b* mounted on the connecting rod 803 release the bundle of paper-sheets 3" to be free. When these clamp members 82*a*, 82*b* make the bundle of paper-sheets 3" to be in a freely released state, it is possible to stop the free fall of the bundle of paper-sheets 3" owing to a fact that the shutter 83 is closed.

Then, it is configured that the motor 89 is driven, the positive rotational movement of the motor 89 is converted to upward movement of the pin by a link mechanism, which is not shown, and the alignment pin 85*a* is fitted with the punch hole 3*a* of the bundle of paper-sheets 3". At that time, it is configured that the side jogger 70 shown in FIG. 9 swings both sides of the bundle of paper-sheets 3" so as to make it easy to insert the alignment pins 85*a*, 85*b*. Thus, it is possible to align the positions of the punch holes 3*a* of the bundle of paper-sheets 3".

Figure 12:
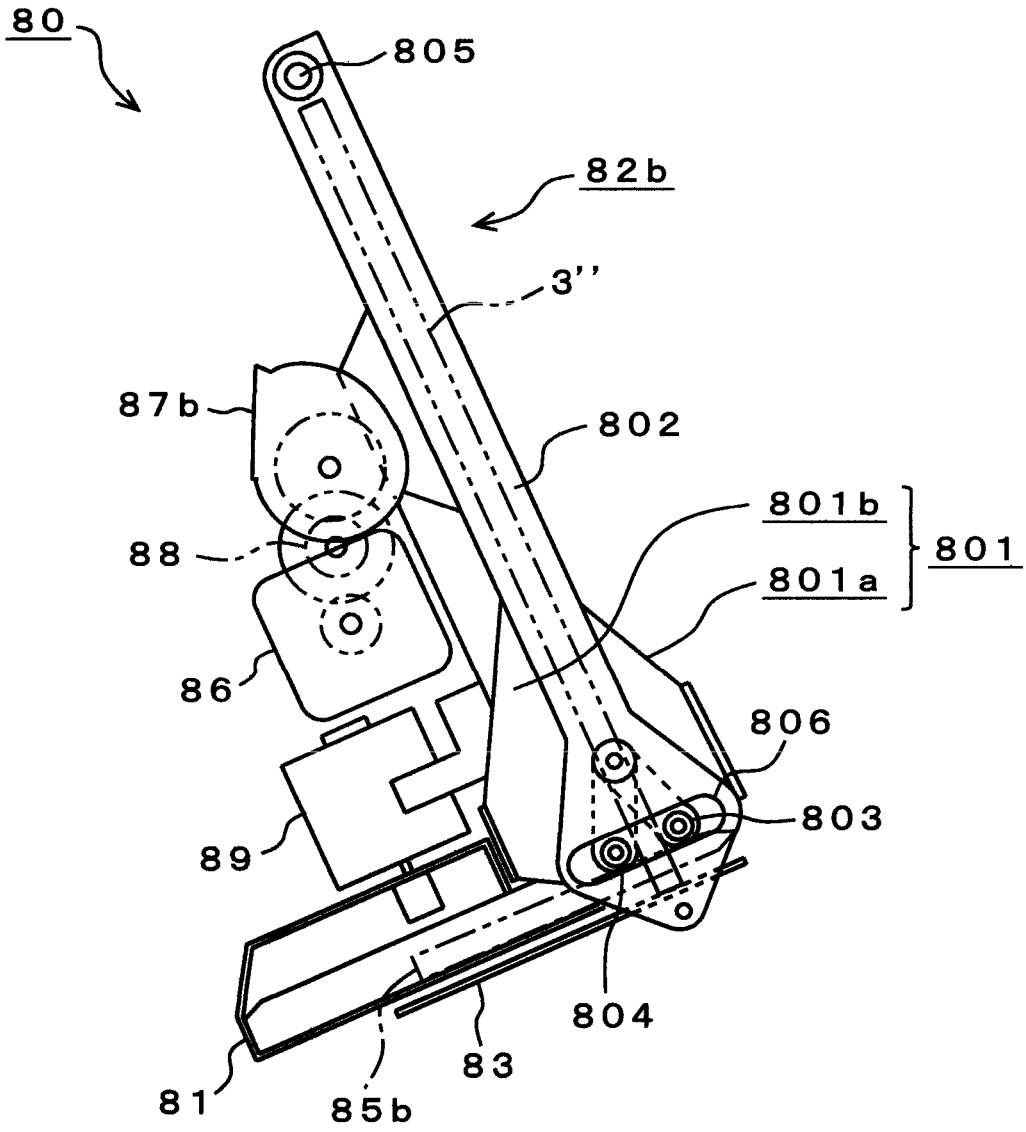
FIG. 12 is a front elevational view showing an operation example (No. 3 thereof) at the time of alignment of a bundle of paper-sheets in the clamp movement mechanism 80.

In this embodiment, the punch holes 3*a* of the bundle of paper-sheets 3ü*h* shown in FIG. 12 are aligned and it is made to be a clamp-lock state again by this alignment pin insertion state. Thereafter, a case in which the alignment pins 85*a*, 85*b* are pulled out from the bundle of paper-sheets 3" will be taken as an example.

Owing to the clamp movement mechanism 80, the cams 87*a* and 87*b* return from the second position (clamp release) to the first position (home position) and take a predetermined posture. For example, the motor 86 rotates reversely and converts the motor rotational frequency by a predetermined gear ratio through the gear unit 88 and transmits the motor rotational force to the cams 87*a* and 87*b*. As a result thereof, the cams 87*a* and 87*b* become in a state of rotating counter-clockwise by 90° from the second position.

At that time, it is configured that in each of the clamp members 82*a* and 82*b*, the clip-shaped member 801 of each of the clamp members 82*a* and 82*b* closes synchronously by a fact that the protrusion portions of the cams 87*a*, 87*b* are made to be in a state of non-depressing with respect to the cam operative region of the movable member 801*a* or 801*b*.

In the clip-shaped member 801, the movable member 801*a* and the movable member 801*b* operate so as to close by making the fulcrum axis member 805 to be a movable reference. The driving force is transmitted to the connecting rod 803 mounted movably on the movable member 801*a* and the connecting rod 804 mounted movably on the movable member 801*b*. As a result thereof, the comb shaped upper portion pressing member 84*a* mounted on the connecting rod 803 and the comb shaped lower portion pressing member 84*b* mounted on the connecting rod 804 hold and fix the bundle of paper-sheets 3".

Thereafter, it is configured that the motor 89 is driven, the reverse rotational movement of the motor 89 is converted to downward movement by a link mechanism, which is not shown, and the alignment pin 85*a* is pulled out from the punch hole 3*a* of the bundle of paper-sheets 3". Thus, it is possible before the binding process to hold and fix the punch hole positions of the bundle of paper-sheets 3" by aligning them.

During this period of time, the shutter 83 operates so as to limit the paper output of the bundle of paper-sheets 3" stored in the paper-sheet reserving unit 32 and thereafter, it is opened so as to slide in a direction perpendicular to the transporting direction of the bundle of paper-sheets 3".

Subsequently, a downward movement adjusting function of the clamp movement mechanism 80 will be explained. In this embodiment, the clamp movement mechanism 80 is provided with a clamp position determining function and a downward movement adjusting function. The clamp position determining function means a function of determining a position at which the bundle of paper-sheets 3" having standard numbers of sheets is held. The downward movement adjusting function means a function of making the transport center position of the paper-sheet to be in conformity with the binding center position of the binding component 43 in a case in which the bundle of paper-sheets 3" comes to include a standard number of sheets, in a case in which it includes a thin number of sheets fewer than that, and in a case in which it includes a thick number of sheets more than that. Hereinafter, these three cases will be explained.

Subsequently, the downward movement adjustment example of the clamp movement mechanism 80 will be explained at the time of the standard number of sheets with reference to FIGS. 13A and 13B.

Figure 13A:
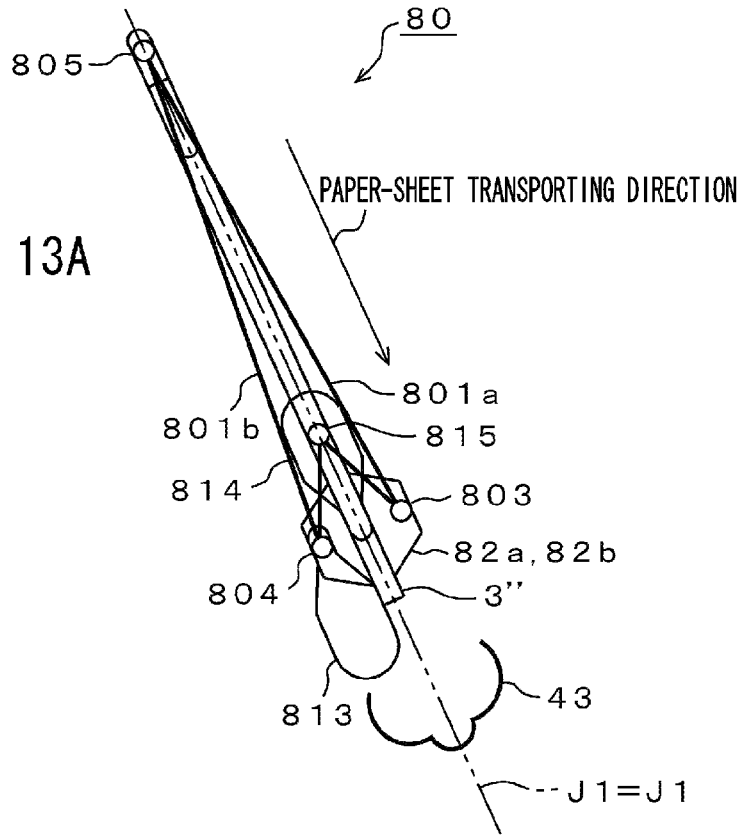
FIG. 13A is a conceptional diagram showing an example of downward movement adjustment of the clamp movement mechanism 80 (at the time of a standard number of sheets).

The clamp movement mechanism 80 shown in FIG. 13A is provided with an opening portion 813 for determining the clamp position. The opening portion 813 has a bottle cross-section shape. It is configured that the clamp position is determined by a fact that the connecting rod 804 falls into a portion corresponding to the bottle neck portion at this opening portion 813.

The clamp movement mechanism 80 is provided with an opening portion 814 for correction other than the opening portion 813. The opening portion 814 for correction is a portion for making correction from the paper-sheet transport center position of the bundle of paper-sheets 3" at the time of thin number of sheets to the paper-sheet transport center position at the time of standard number of sheets and from the paper-sheet transport center position of the bundle of paper-sheets 3" at the time of thick number of sheets to the paper-sheet transport center position at the time of standard number of sheets. A post 815 in the opening portion 814 for correction is a movable axis for engaging link members of the clamp members 82*a*, 82*b*.

The clamp members 82*a*, 82*b* hold the bundle of paper-sheets 3" of the standard number of sheets and move to the downstream side along the paper-sheet transporting direction in a state of holding bundle of paper-sheets 3" with respect to the main body substrate 81 shown in FIG. 5. In this case, it is designed such that the paper-sheet transport center position and the binding center position of the binding component 43 will coincide. Here, the paper-sheet transporting center position means a position dividing the thickness of the bundle of paper-sheets 3" by ½ in the thickness direction thereof. Also, the binding center position means a position of the backbone of the binding component 43. Consequently, in a case in which the bundle of paper-sheets 3" has a standard number of sheets, the downward movement adjustment is omitted.

Figure 13B:
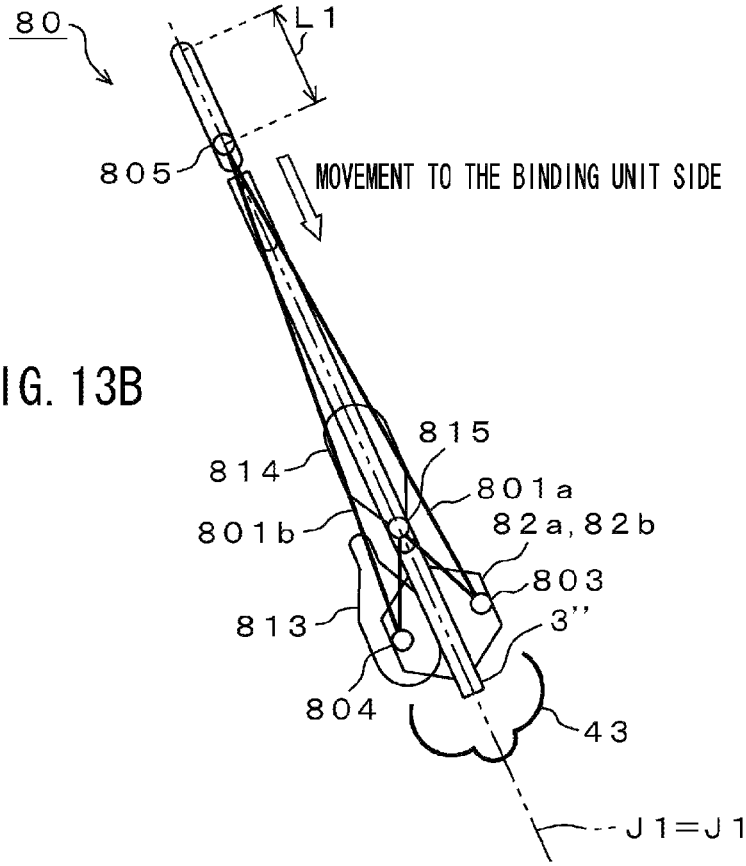
FIG. 13B is a conceptional diagram showing a state example after the downward movement of the clamp movement mechanism 80 at the time of a standard number of sheets.

In this embodiment, the clamp members 82*a*, 82*b* descend directed to a center of the binding component 43 of the half-bound state as shown in FIG. 13B, which the binding process unit 40 provides, with the clamp movement mechanism 80 clamping the bundle of paper-sheets 3". The clamp members 82*a*, 82*b* descend (move) to the binding unit side by an offset distance L1 shown in the drawing by making the home position of the fulcrum axis member 805 to be a reference.

The clamp movement mechanism 80 operates during the descent of these clamp members 82*a*, 82*b* such that the paper-sheet transport center position and the binding center position will coincide. Thereafter, it is configured that when the punch holes 3*a* of the bundle of paper-sheets 3" reach the center of the binding component 43 in the half-bound state, the binding component 43 is bind-processed by the binding process unit 40. This enables the punch holes 3*a* of the bundle of paper-sheets 3" to be bound with the binding component 43.

Subsequently, the downward movement adjustment example of the clamp movement mechanism 80 will be explained at the time of thin number of sheets with reference to FIGS. 14A and 14B.

Figure 14A:
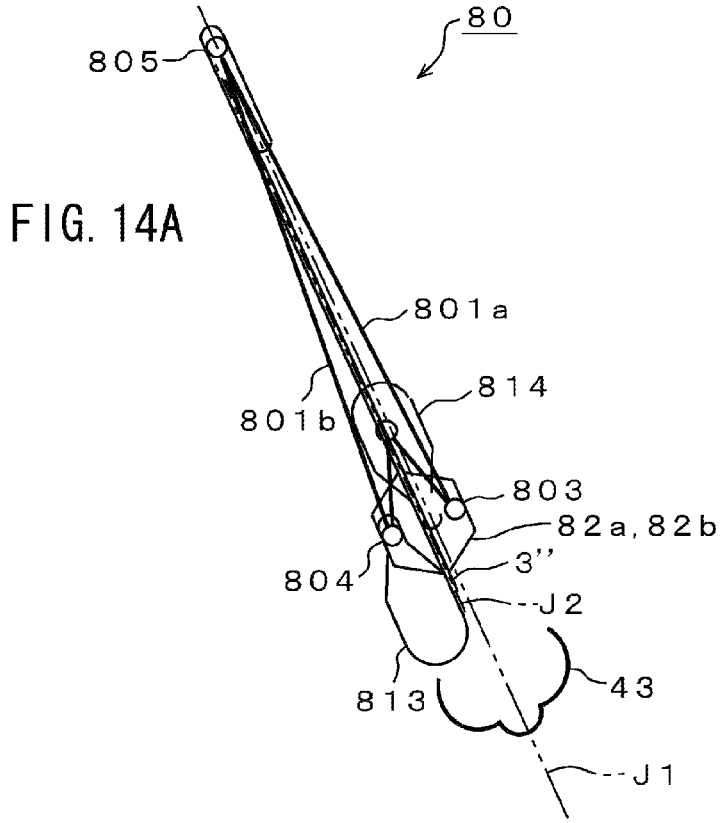
FIG. 14A is a conceptional diagram showing a downward movement adjustment example of the clamp movement mechanism 80 (at the time of a thin number of sheets).
Figure 14B:
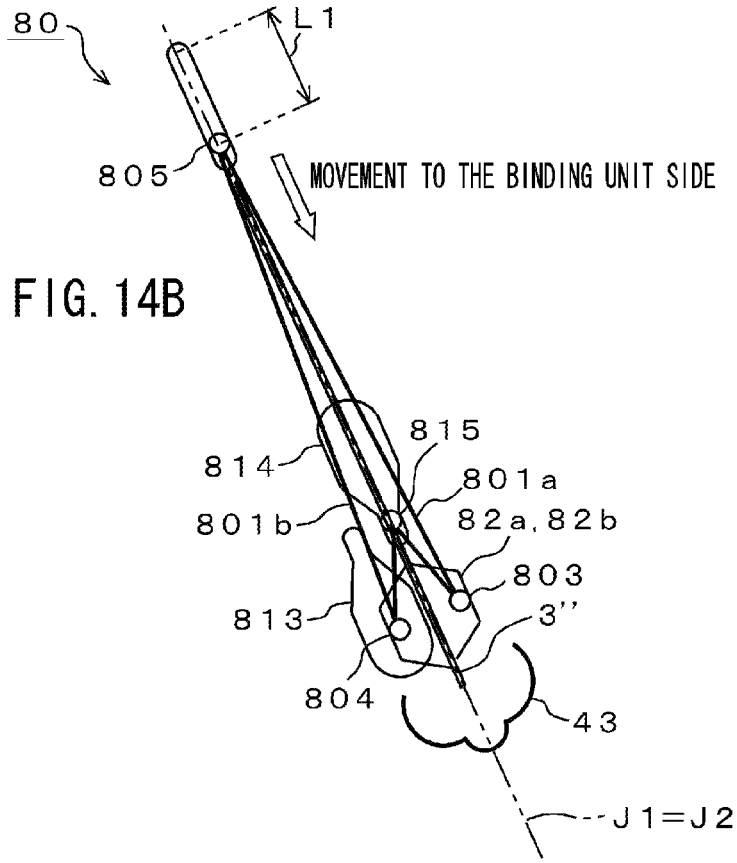
FIG. 14B is a conceptional diagram showing a state example after the downward movement of the clamp movement mechanism 80 at the time of a thin number of sheets.

The clamp members 82*a*, 82*b* shown in FIG. 14A hold the bundle of paper-sheets 3" of thinner number of sheets than the standard number of sheets and are in a case of moving to the downstream side along the paper-sheet transporting direction in a state of holding the bundle of paper-sheets 3" with respect to the main body substrate 81 shown in FIG. 5. In this case, the paper-sheet transport center position of the bundle of paper-sheets 3" at the time of thin number of sheets is out of alignment to the left side (bottom portion side of the paper-sheet reserving unit 32) compared with the paper-sheet transport center position at the time of standard number of sheets. If this state is maintained, it does not coincide with the binding center position of the binding component 43.

Consequently, the opening portion 814 for correction functions so as to correct the paper-sheet transport center position of the bundle of paper-sheets 3" at the time of thin number of sheets to the paper-sheet transport center position at the time of standard number of sheets. The opening portion 814 for correction functions so as to shift the front edge of the bundle of paper-sheets from the right side to the left side by utilizing the bottle cross-section shape thereof. Owing to the function of this opening portion 814 for correction, the clamp members 82*a*, 82*b* descend directed to the center of the binding component 43 in the half-bound state as shown in FIG. 14B while changing the posture from the paper-sheet transport center position of the bundle of paper-sheets 3" at the time of thin number of sheets to the paper-sheet transport center position thereof at the time of standard number of sheets. At a point of time when these clamp members 82*a*, 82*b* complete the descent, the clamp movement mechanism 80 operates such that the paper-sheet transport center position of the bundle of paper-sheets 3" at the time of thin number of sheets will coincide with the binding center position. Thereafter, it is configured that the binding component 43 is bind-processed similarly as FIG. 13B. This enables the bundle of paper-sheets 3" to be bound even if the bundle of paper-sheets 3" has thinner number of sheets than the standard number of sheets.

Subsequently, the downward movement adjustment example of the clamp movement mechanism 80 will be explained at the time of thick number of sheets with reference to FIGS. 15A and 15B.

Figure 15A:
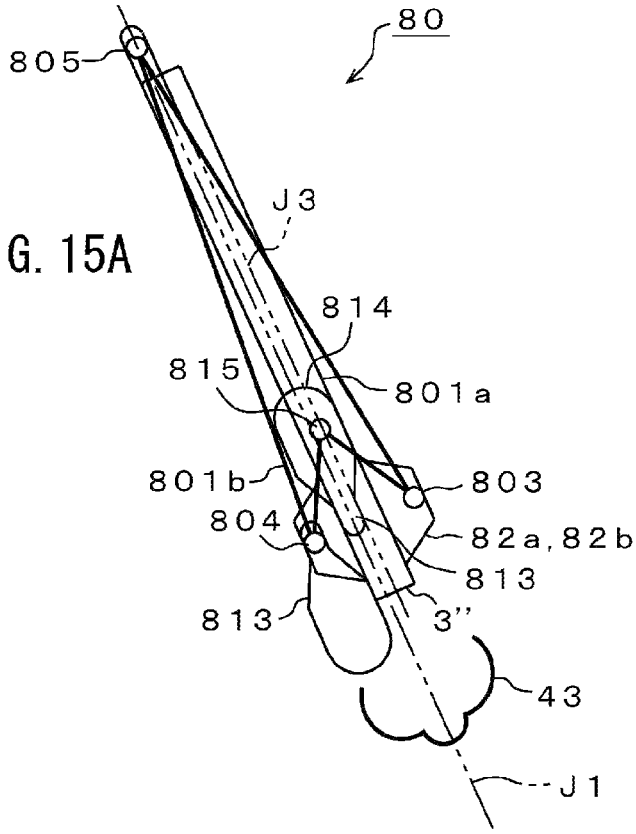
FIG. 15A is a conceptional diagram showing a downward movement adjustment example of the clamp movement mechanism 80 (at the time of a thick number of sheets).
Figure 15B:
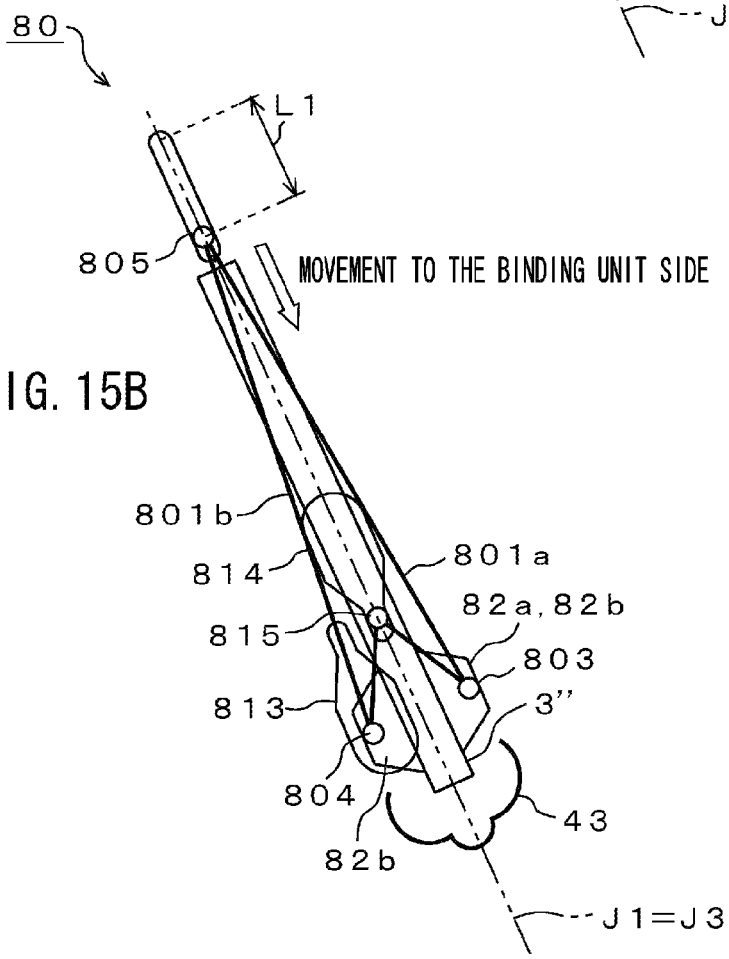
FIG. 15B is a conceptional diagram showing a state example after the downward movement of the clamp movement mechanism 80 at the time of a thick number of sheets.

The clamp members 82*a*, 82*b* shown in FIG. 15A hold the bundle of paper-sheets 3" of thicker number of sheets than the standard number of sheets and move to the downstream side along the paper-sheet transporting direction in a state of holding the bundle of paper-sheets 3" with respect to the main body substrate 81 shown in FIG. 5. In this case, the paper-sheet transport center position of the bundle of paper-sheets 3" at the time of thick number of sheets is out of alignment to the right side (upper portion side of the paper-sheet reserving unit 32) compared with the paper-sheet transport center position at the time of standard number of sheets. If this state is maintained, it does not coincide with the binding center position of the binding component 43.

Consequently, the opening portion 814 for correction functions so as to correct the paper-sheet transport center position of the bundle of paper-sheets 3" at the time of thick number of sheets to the paper-sheet transport center position at the time of standard number of sheets. The opening portion for correction functions so as to shift the front edge of the bundle of paper-sheets from the left side to the right side by utilizing the bottle cross-section shape thereof. Owing to the function of this opening portion 814 for correction, the clamp members 82*a*, 82*b* descend directed to the center of the binding component 43 in the half-bound state as shown in FIG. 15B while changing the posture from the paper-sheet transport center position of the bundle of paper-sheets 3" at the time of thick number of sheets to the paper-sheet transport center position at the time of standard number of sheets. At a point of time when these clamp members 82*a*, 82*b* complete the descent, the clamp movement mechanism 80 operates such that the paper-sheet transport center position of the bundle of paper-sheets 3" at the time of thick number of sheets will coincide with the binding center position. Thereafter, it is configured that the binding component 43 is bind-processed similarly as FIG. 14B. This enables the bundle of paper-sheets 3" to be bound even if the bundle of paper-sheets 3" has thicker number of sheets than the standard number of sheets.

Figure 16:
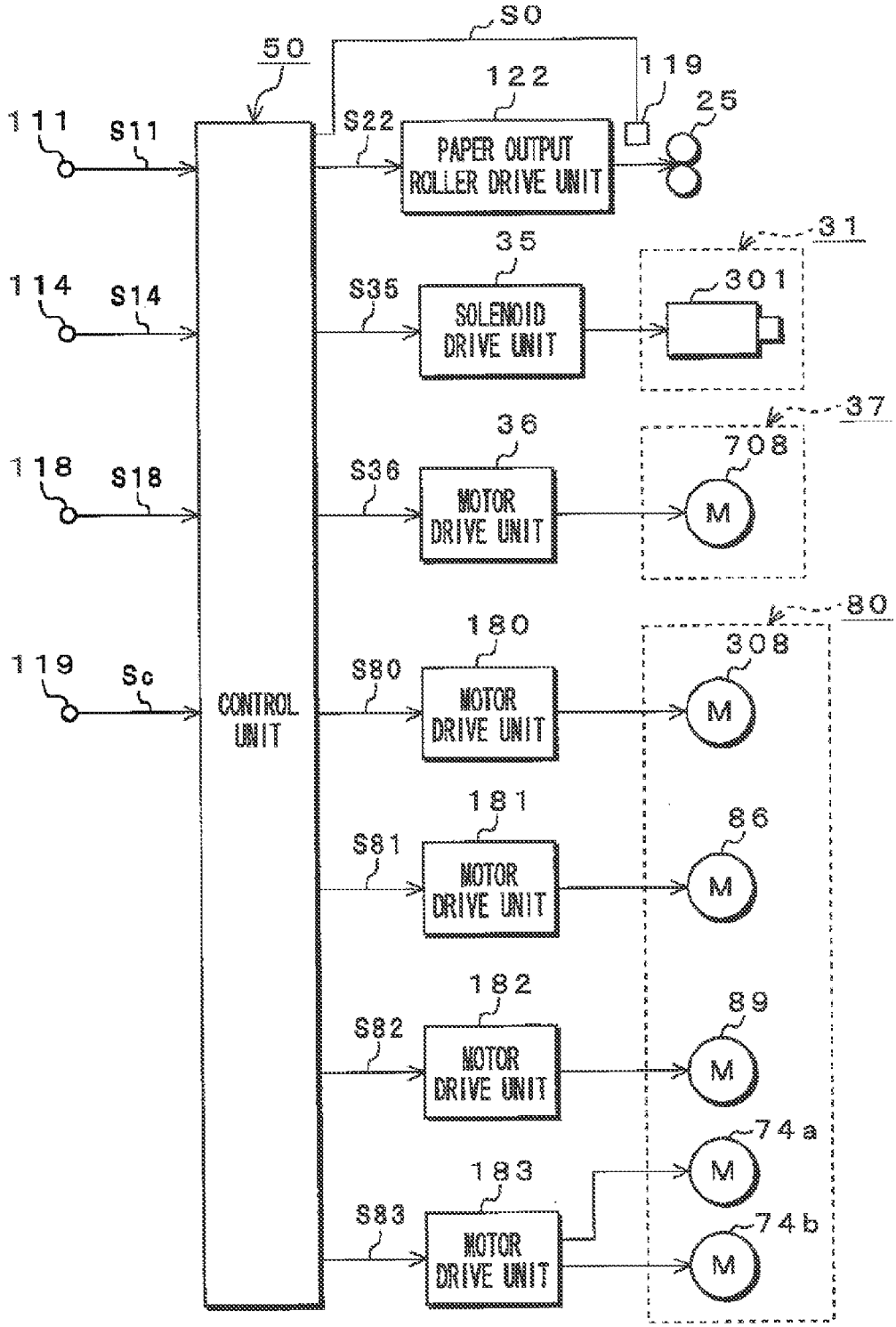
FIG. 16 is a block diagram showing a configuration example of a control system of the binder paper alignment unit 30.

Subsequently, a confuguration example of a control system of the binder paper alignment unit will be explained with reference to FIG. 16. To the output side of the control unit 50 shown in FIG. 16, a solenoid drive unit 35, a motor drive unit 36, a paper output roller drive unit 122, and motor drive units 180 to 183 are connected.

The solenoid drive unit 35 releases the immobilizing function by the right and left pressing members 304*a*, 304*b* when the paper proceeds and controls the rotatable guide portions 34*a*, 34*b* such that the aforesaid pressing members 304*a*, 304*b* can function as driving guides for guiding the paper-sheet 3' to the paper-sheet reserving unit 32. Depending on this control, the rotatable guide portions 34*a*, 34*b* release the pressing members 304*a*, 304*b* on both sides when the paper-sheet proceeds and become driving guides for guiding it to the paper-sheet reserving unit 32.

The solenoid drive unit 35 closes the immobilizing function by the pressing members 304*a*, 304*b* after the paper proceeding is completed, for example, at the time of binding process and controls the rotatable guide portions 34*a*, 34*b* such that the aforesaid pressing members 304*a*, 304*b* can function as flat surface attachment components for immobilizing the rear end side of the paper-sheet 3' reserved in the paper-sheet reserving unit 32. Depending on this control, the rotatable guide portions 34*a*, 34*b* close the driving guide after the proceeding of the paper-sheet is completed and are operated so as to immobilize the paper-sheet 3' stored in the paper-sheet reserving unit 32 by both side portions of the rear end side thereof.

The control unit 50 at least drives the rotatable guide portions 34*a*, 34*b* in time divisional manner by controlling the output of the solenoid drive unit 35. For example, the control unit 50 outputs a paper output control signal S22 to the paper output roller drive unit when outputting the paper-sheet 3' after the punching process. it is configured that the paper output roller drive unit 122 outputs the paper-sheet 3' after the punching process downward based on the paper output control signal S22.

The control unit 50 outputs a solenoid control signal S35 to the solenoid drive unit 35 during driving the paper output roller 25 or for every drive thereof. It is configured that the solenoid drive unit 35 drives the solenoid 301 based on the solenoid control signal S35 to release the immobilizing function by the pressing members 304*a*, 304*b*. Also, the solenoid drive unit 35 drives the solenoid 301 based on the solenoid control signal S35 when the paper proceeds and it comes to execute the immobilizing function by the pressing members 304*a*, 304*b*. This enables the paper-sheet guide pressing mechanism 31 to be controlled.

It is configured that the motor drive unit 36 is connected to the control unit 50, which controls the paddle roller unit 37. It is configured that the paddle roller unit 37 is provided with a motor 708. For example, the motor drive unit 36 is inputted with a motor control signal S36 from the control unit 50 and drives the motor 708, so that the paddle roller unit 37 can be controlled.

It is configured that the motor drive units 180 to 183 are connected to the control unit 50, which controls the clamp movement mechanism 80. The clamp movement mechanism 80 is provided with motors 74*a*, 74*b*, a motor 86, a motor 89, and a motor 308. For example, It is configured that the motor drive unit 180 is inputted with a movement control signal S80 from the control unit 50 and drives the motor 308 for the shutter, so that the shutter 83 shown in FIG. 5 can be opened and closed.

It is configured that the motor drive unit 181 is inputted with a movement control signal S81 from the control unit 50 and drives the motor 86 for clamp drive, so that the clamp members 82*a*, 82*b* shown in FIG. 5 can be driven and controlled. It is configured that the motor drive unit 182 is inputted with a movement control signal S82 from the control unit 50 and drives the motor 89 for driving the alignment pin, so that the alignment pins 85*a*, 85*b* shown in FIG. 10 to FIG. 12 can be driven and controlled. It is configured that the motor drive unit 183 is inputted with a movement control signal S83 from the control unit 50 and drives the motors 74*a*, 74*b* for the side jogger, so that the side jogger 70 shown in FIG. 7 to FIG. 9 can be driven and controlled.

It should be noted that to the input side of the control unit 50, a paper feed sensor 111, a paper-sheet detecting sensors 114, 118, and a paper-sheet detecting sensor 119 are connected respectively. The paper feed sensor 111 detects the front edge of the paper-sheet 3 when feeding the paper and outputs a paper feed detection signal S11 to the control unit 50. The paper-sheet detecting sensor 114 detects the front end and the rear end of the paper-sheet 3 just before the switch-back and outputs a paper-sheet detection signal S14 to the control unit 50. The paper-sheet detecting sensor 118 detects the front end and the rear end of the paper-sheet 3 just before the punch and outputs a paper-sheet detection signal S18 to the control unit 50. The paper-sheet detecting sensor 119 counts the number of sheets of the paper-sheets 3' stored in the binder paper alignment unit 30 and outputs a paper-sheet detection signal Sc to the control unit 50. It is constituted in this embodiment such that the control is to be executed based on the paper-sheet detection by the paper-sheet detecting sensor 119. It is configured that the control unit 50 controls the clamp movement mechanism 80 and the binding process unit 40 based on the paper-sheet detection signal Sc.

Subsequently, a configuration example of the movement mechanism 41 in the binding process unit 40 will be explained with reference to FIG. 17A and FIG. 17B.

Figure 17A:
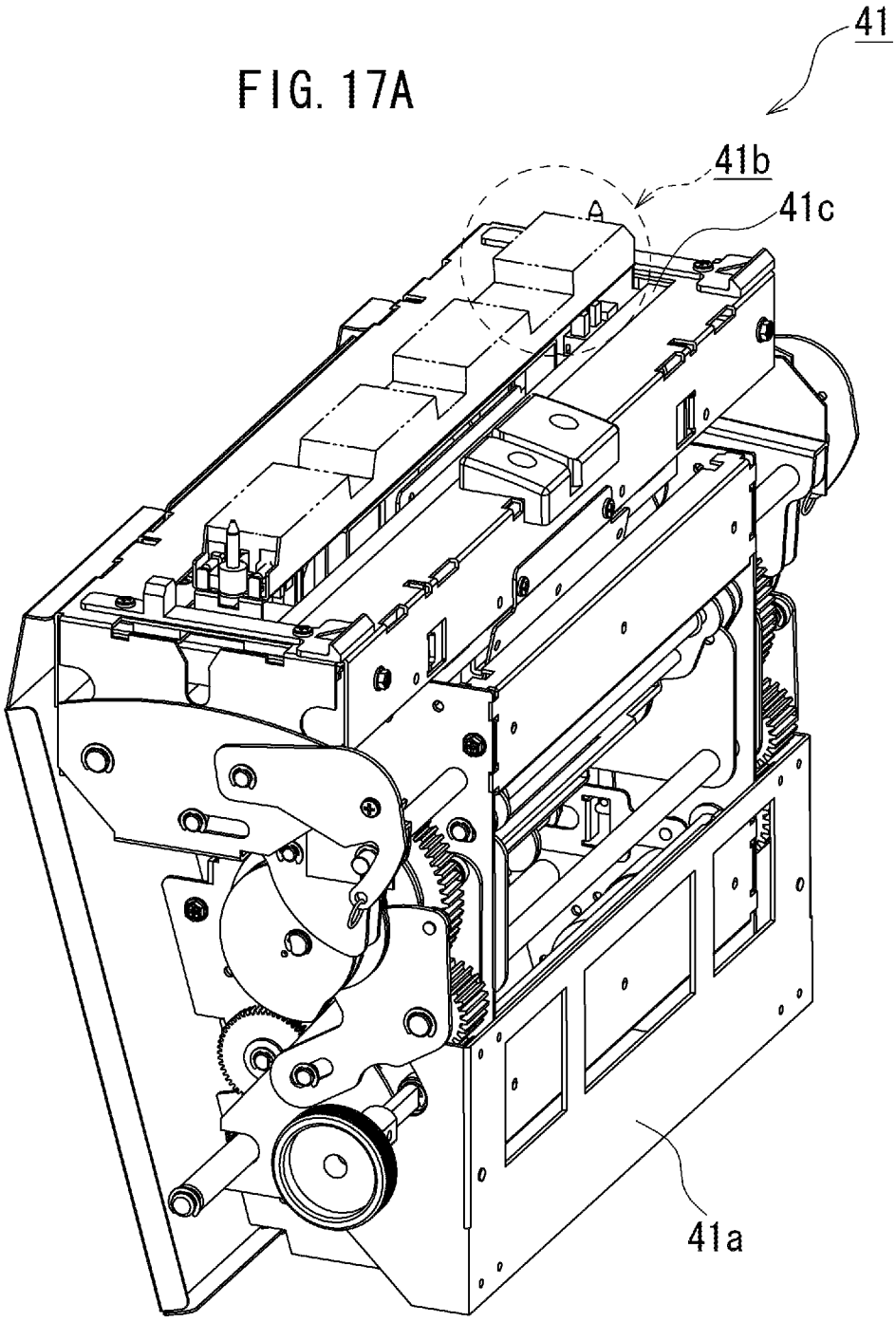
FIG. 17A is a perspective view showing a configuration example of the movement mechanism 41 in a binding process unit 40.

The movement mechanism 41 shown in FIG. 17A is constituted by being provided with a main body portion 41*a* and a binding component gripping portion 41*b* which is inside the main body portion 41*a*. The binding component gripping portion 41*b* has so constitution as to be movable upward and downward in which the tip portion thereof is positioned inside and outside the main body portion 41*a* through the opening portion 41*c* at the upper portion of the main body portion 41*a*.

Figure 17B:
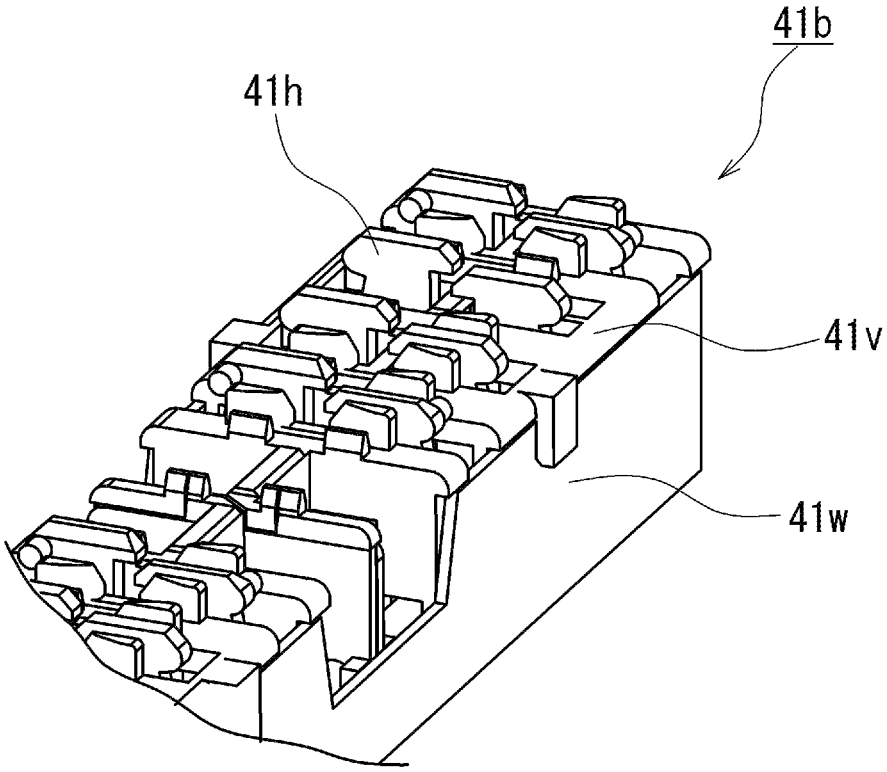
FIG. 17B is an enlarged perspective view showing a configuration example of an upper edge portion of a binding component gripping portion 41*b*.

Also, in the enlarged view of the upper edge portion of the binding component gripping portion 41*b* shown in FIG. 17B, a plurality of binding component gripping claws 41*h*, gripping claw holders 41*v*, and a holder fixing frame 41*w* are provided at the upper edge portion of the binding component gripping portion 41*b*. In this embodiment, it is constituted such that the gripping claw holders 41*v* are in a state of being fixed by the holder fixing frame 41*w* at the upper edge portion of the binding component gripping portion 41*b*. The binding component gripping claws 41*h* are positioned inside the gripping claw holder 41*v* such that the upper edge portion thereof becomes in a state of being projected upward the gripping claw holder 41*v*.

Figure 18A:
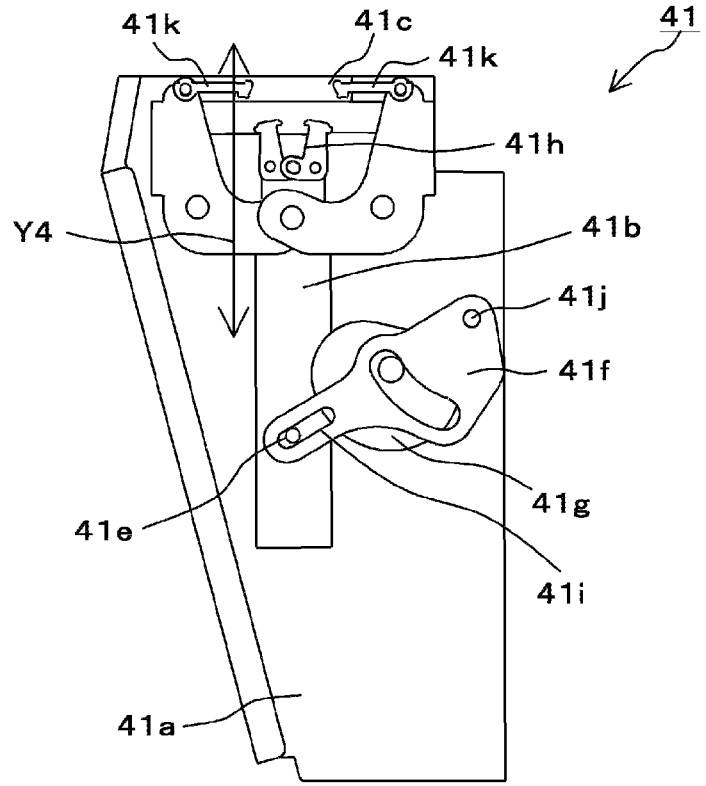
FIG. 18A is a diagram showing a configuration example in the binding component gripping portion 41*b* of the movement mechanism 41.
Figure 18B:
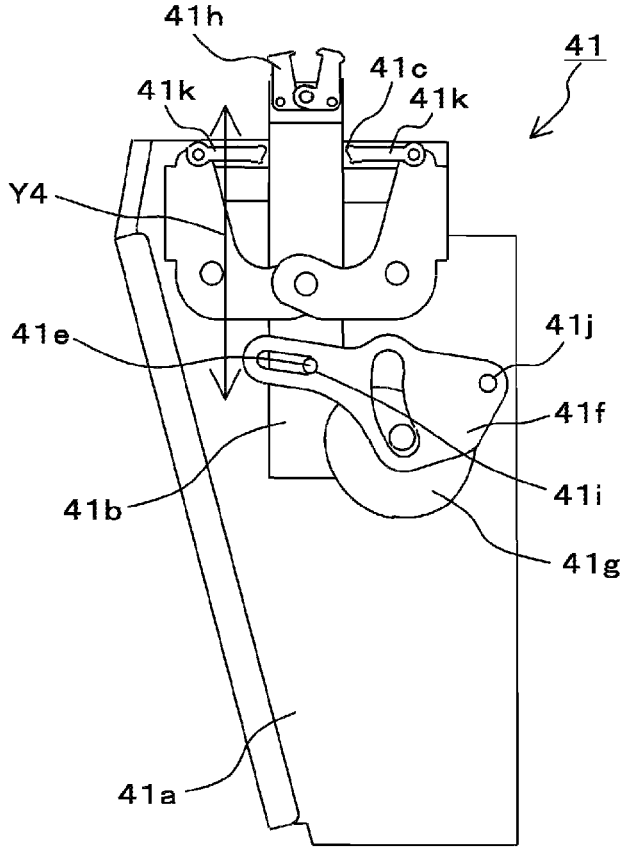
FIG. 18B is a constitution diagram showing an operation example at the time of up and down movements of the movement mechanism 41.

FIGS. 18A and 18B are constitution diagrams showing a configuration example of the binding component gripping portion 41*b* of the movement mechanism 41 and an operation example thereof (at the time of up and down movement). In this embodiment, a configuration example and an operation example of the related members in the cross section of the movement mechanism 41 will be explained.

In order to move the binding component gripping portion 41*b* upward and downward, the movement mechanism 41 shown in FIG. 18A is constituted by being provided, for example, with a binding component gripping portion 41*b*, a gripping portion link 41*f*, a cam 41*g* for the gripping portion, binding claws 41*k*, and a motor 45*b* for moving the gripping portion up and down (which is not shown). In this embodiment, the binding component gripping portion 41*b* shows a state of being positioned at the lowermost portion thereof. The binding claws 41*k* have a function of binding the binding component 43 in a ring shape.

The binding component gripping portion 41*b* has, for example, a predetermined height and the widths in the lateral direction and longitudinal direction have a little bit small shapes compared with those of the opening portion 41*c*. Also, a plurality of binding component gripping claws 41*h* for gripping the binding component 43 are provided at the upper edge portion of the binding component gripping portion 41*b*.

Further, the binding component gripping portion 41*b* has a convexity-shaped gripping portion link coupling portion 41*e* on the side surface. The binding component gripping portion 41*b* and the gripping portion link 41*f* are constituted in a state such that the gripping portion link coupling portion 41*e* is coupled with a long-hole shaped gripping portion coupling hole 41*i* of the gripping portion link 41*f* by being fitted therewith. The gripping portion link 41*f* is jointed with the cam 41*g* for the gripping portion and is constituted to be rotatable on the axis of a gripping portion link rotating axis 41*j* depending on a fact that the cam 41*g* for the gripping portion rotates. Further, the binding component gripping portion 41*b* is in a state in which force is always applied to the upper direction by means of the motor 45*b* for moving the gripping portion up and down or the like.

The movement mechanism 41 shown in FIG. 18B shows a case in which the binding component gripping portion 41*b* is moved from the state of being positioned at the lowermost portion shown in FIG. 18A to a state of being positioned at the uppermost portion thereof. In this case, the gripping portion link 41*f* rotates depending on a fact that the motor 45*b* mentioned above rotates the cam 41*g* for the gripping portion positively and this cam 41*g* for the gripping portion rotates. Thus, the position and the posture of the gripping portion coupling hole 41*i* change and accordingly, it is configured that the binding component gripping portion 41*b* is movable to the upper direction as shown in an arrow Y4 through the gripping portion link coupling portion 41*e*. Here, it is configured that the binding component gripping portion 41*b* becomes movable to the downward direction as shown in the arrow Y4 depending on a fact that the motor 45*b* mentioned above rotates the cam 41*g* for the gripping portion reversely and this cam 41*g* for the gripping portion rotates reversely.

In this manner, it is constituted such that the binding component gripping portion 41*b* is movable from the lowermost portion shown by FIG. 18A to the uppermost portion shown by FIG. 18B. The up and down movement control of this binding component gripping portion 41*b* is carried out by driving the motor 45*b* for moving the gripping portion up and down based on a motor control signal S41 from the control unit 50 shown in FIG. 20 and by rotating the cam 41*g* for the gripping portion.

Also, in a state in which the binding component gripping portion 41*b* shown in FIG. 18A is positioned at the lowermost portion, the binding component gripping claws 41*h* are positioned inside the main body portion 41*a*. Further, it is configured that as shown in FIG. 18B, in a state in which the binding component gripping portion 41*b* is positioned at the uppermost portion, the binding component gripping claws 41*h* are positioned outside the main body portion 41*a*.

Subsequently, an extraction example (Nos. 1 to 4 thereof) of the binding component 43 by the movement mechanism 41 will be explained with reference to FIGS. 19A to 19D. In this embodiment, an operation example of the related members in the cross section of the movement mechanism 41 will be explained. Cases are assumed in this embodiment from a case in which the movement mechanism 41 separates one piece of binding component 43 from the inside of the binder cassette 42 and extracts it in a state of lying at the binding component extraction position under the binder cassette 42 to a case in which aforesaid binding component 43 is made to be in a half-bound state. In this process, the rotation for the binder paper alignment unit 30 is not carried out.

Figure 19A:
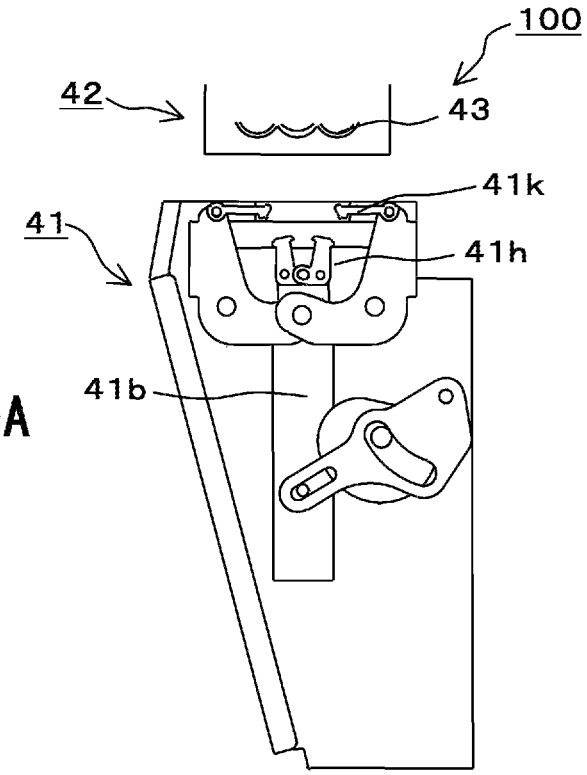
FIG. 19A is a process diagram showing an extraction example (No. 1 thereof) of a binding component 43 by the movement mechanism 41.

The binding component gripping portion 41*b* shown in FIG. 19A lies in a state being positioned at the lowermost portion. The binding component 43 is set inside binder cassette 42. From that state, the gripping portion link 41*f* rotates depending on a fact, as explained in FIG. 18A, that the motor 45*b* rotates the cam 41*g* for the gripping portion positively and this cam 41*g* for the gripping portion rotates. Thus, the position and the posture of the gripping portion coupling hole 41*i* change and accordingly, the binding component gripping portion 41*b* moves to the upper direction through the gripping portion link coupling portion 41*e*.

Figure 19B:
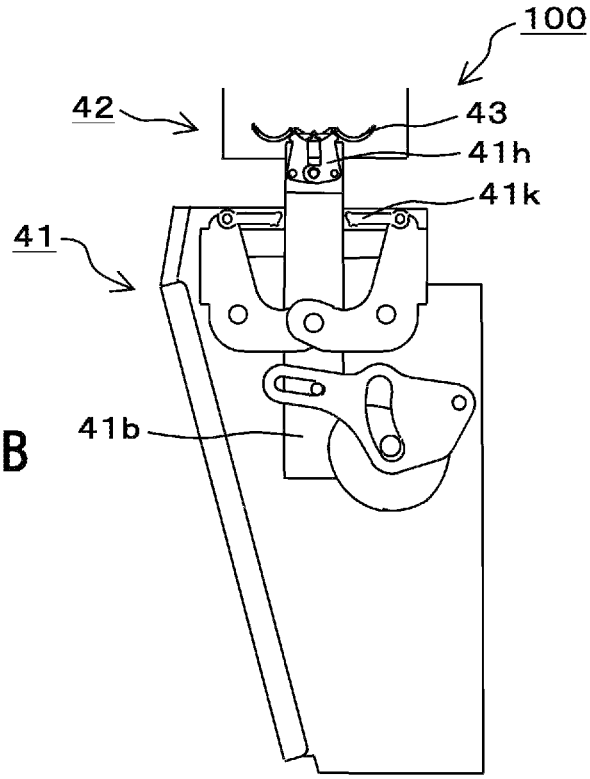
FIG. 19B is a process diagram showing an extraction example (No. 2 thereof) of a binding component 43 by the movement mechanism 41.

By the movement of this binding component gripping portion 41*b*, the binding component gripping claws 41*h* shown in FIG. 19B become in a state of gripping the binding component 43 by only one piece. It is configured that in this state, the motor 45*b* rotates the cam 41*g* for the gripping portion reversely and the binding component gripping portion 41*b* is made so as to move to the downward direction depending on a fact that this cam 41*g* for the gripping portion rotates reversely.

Figure 19C:
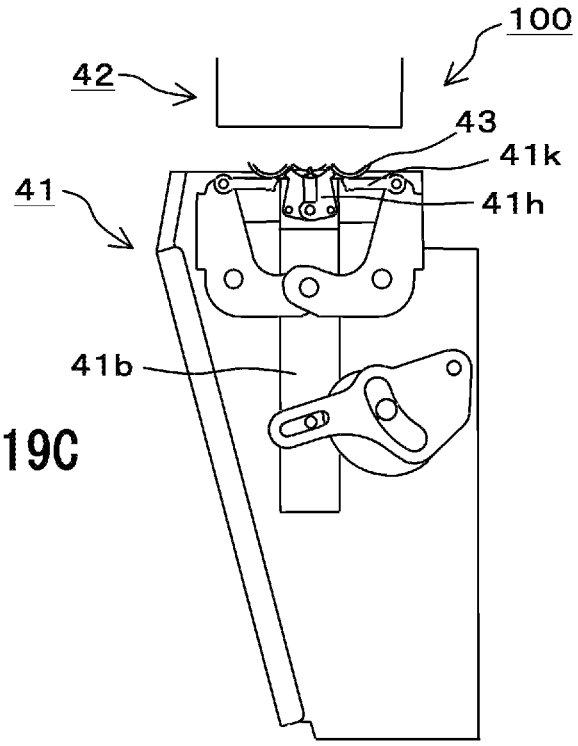
FIG. 19C is a process diagram showing an extraction example (No. 3 thereof) of a binding component 43 by the movement mechanism 41.
Figure 19D:
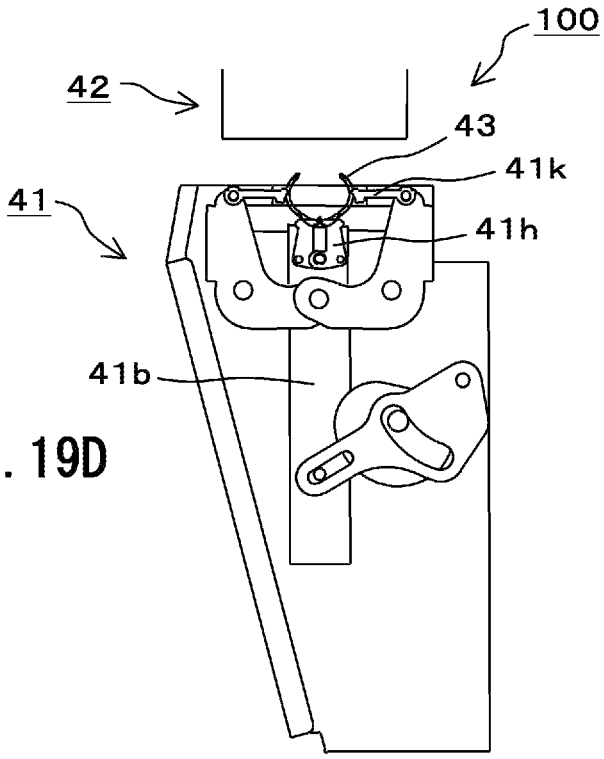
FIG. 19D is a process diagram showing an extraction example (No. 4 thereof) of a binding component 43 by the movement mechanism 41.

After extracting the binding component 43 from the inside of the binder cassette 42 and when the binding component gripping portion 41*b* is moved downward, it becomes in a state, as shown in FIG. 19C, in which the binding component 43 contacts the binding claws 41*k*. At that time, the binding claws 41*k* are in a state of being open. Thereafter, as shown in FIG. 19C, the binding component gripping portion 41*b* is moved so as to be drawn further downward to the position of the lowermost portion by maintaining the state in which the binding claws 41*k* are open. At that time, as shown in FIG. 19D, a ring portion 43*d* and a ring portion 43*e* of each ring portion 43*b* of the binding component 43 are pushed by the binding claws 41*k* and are folded by a predetermined amount, so that it is possible to make them in a half-bound state (this work operation is referred to as first forming of the binding component 43).

Figure 20:
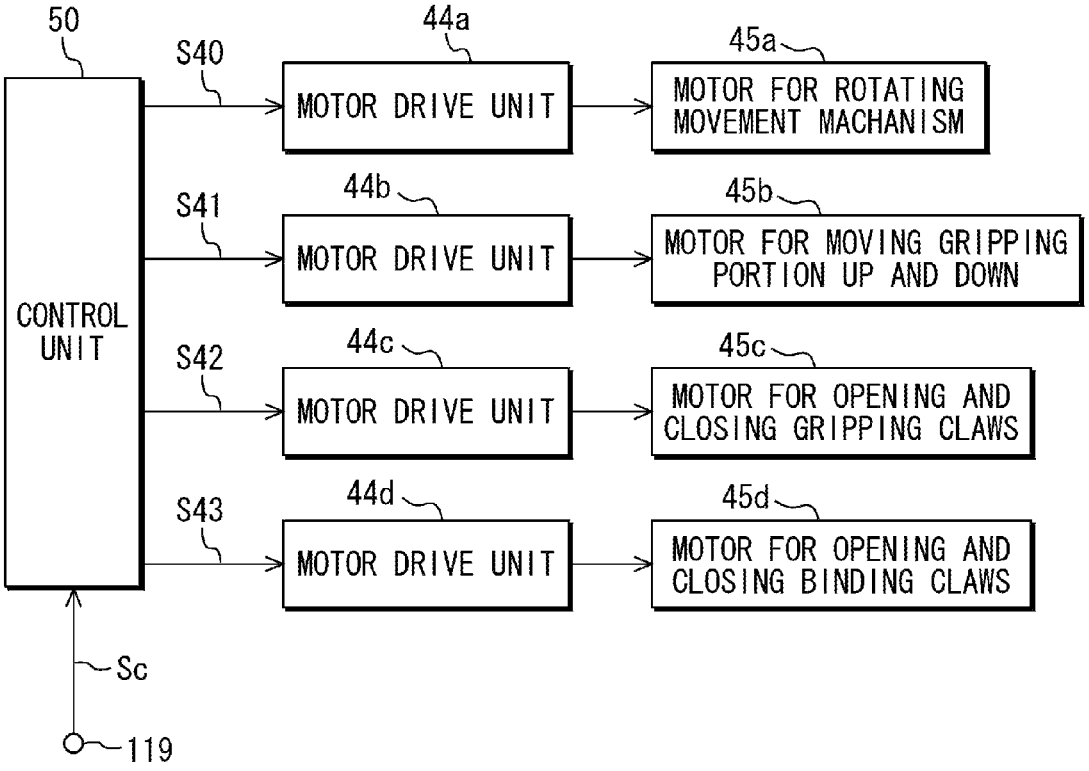
FIG. 20 is a block diagram showing a configuration example of a control system of the binding process unit 40.

Subsequently, a configuration example of a control system of the binding process unit 40 will be explained with reference to FIG. 20. The control unit 50 shown in FIG. 20 is constituted by including, for example, a central process unit (CPU), which is not shown, a memory and the like. The control unit 50 is connected with motor drive units 44*a*, 44*b*, 44*c* and 44*d*. The control unit 50 controls the motor drive units 44*a*, 44*b*, 44*c* and 44*d* based on an output of the paper-sheet detecting sensor 119.

For example, the control unit 50 shifts to the binding component acquisition and the binding control when the paper-sheet detection signal Sc to the effect that one sheet of the paper-sheet 3' is detected is inputted from the paper-sheet detecting sensor 119. The motor drive unit 44*a* is connected to the motor 45*a* for rotating movement mechanism and drives the motor 45*a* based on the motor control signal S40 from the control unit 50. The motor 45*a* drives the movement mechanism 41 based on the motor control signal S40. The motor drive unit 44*b* is connected to the motor 45*b* for moving gripping portion up and down and drives the motor 45*b* based on the motor control signal S41 from the control unit 50. The motor 45*b* drives the binding component gripping portion 41*b* upward and downward based on the motor control signal S41.

Also, the motor drive unit 44*c* is connected to a motor 45*c* for opening and closing gripping claws and drives the motor 45*c* based on a motor control signal S42. The motor 45*c* drives the binding component gripping claws 41*h* to be opened and closed based on the motor control signal S42 from the control unit 50. The motor drive unit 44*d* is connected to a motor 45*d* for opening and closing the binding claws and drives the motor 45*d* based on a motor control signal S43. The motor 45*d* drives the binding claws 41*k* to be opened and closed based on the motor control signal S43 from the control unit 50.

Next, it will be explained with respect to a constitution example of the binder cassette 42 with reference to FIG. 21 and FIG. 22.

Figure 21:
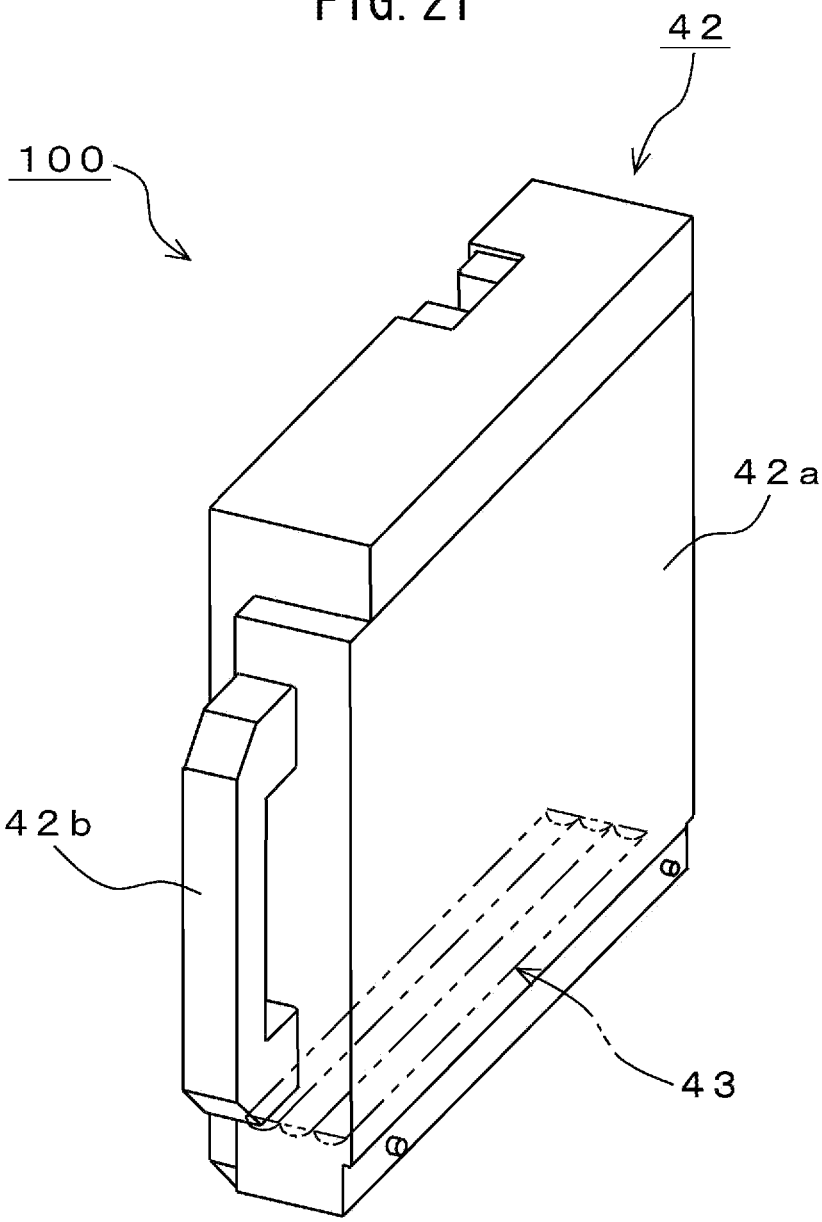
FIG. 21 is a perspective view showing a configuration example of an exterior appearance of the binder cassette 42.

The binder cassette 42 shown in FIG. 21 constitutes one example of the commodity storage means and is a cassette which stores the binding components 43. The binder cassette 42 is constituted by being provided with a housing-shaped binding component storing unit 42*a* and its handle 42*b*. The binder cassette 42 has a configuration which can be mounted (attached) and desorbed (detached) with respect to the binding device 100 by means of the handle 42*b*. There is provided at the lower surface portion of the binding component storing unit 42*a* with an extraction hole 42*c* as shown in FIG. 22.

Figure 22:
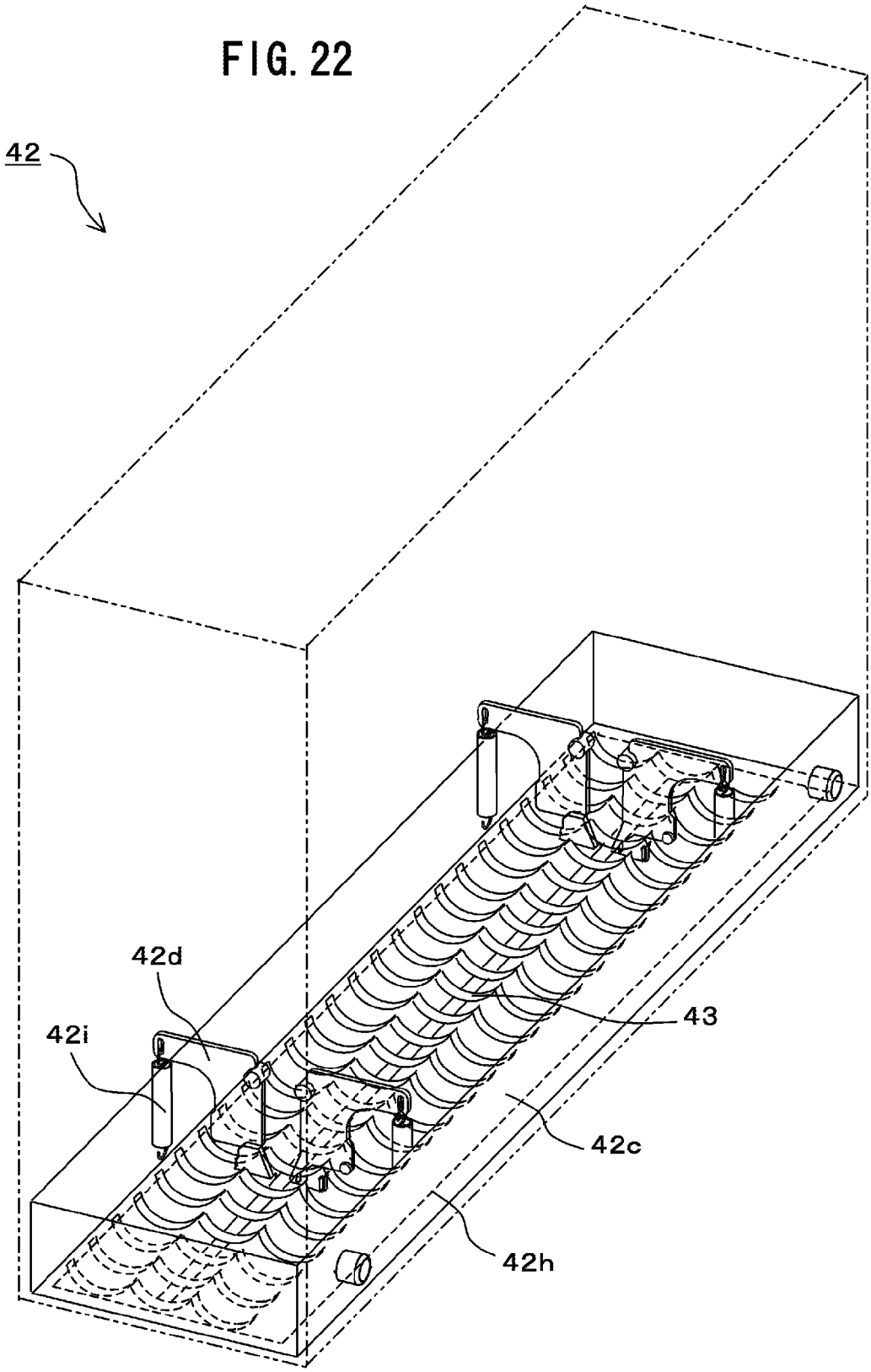
FIG. 22 is a perspective view showing an internal configuration example of the binder cassette 42.

There is provided in the vicinity of the lower edge portion of the binder cassette 42 shown in FIG. 22 with an extraction hole 42*c* shown by dotted lines in the drawing. There are provided at a predetermined position of the upper portion of the extraction hole 42*c* with a binding component pressing claws 42*d*. The binding component pressing claws 42*d* are constituted as one set by two pieces in a state of facing each other. The binding component pressing claw 42*d* constitutes one example of the supporting portion and is formed in an L-shaped flat plate. The binding component pressing claw 42*d* and a spring 42*i* are to constitute one example of the support means.

Figure 23A:
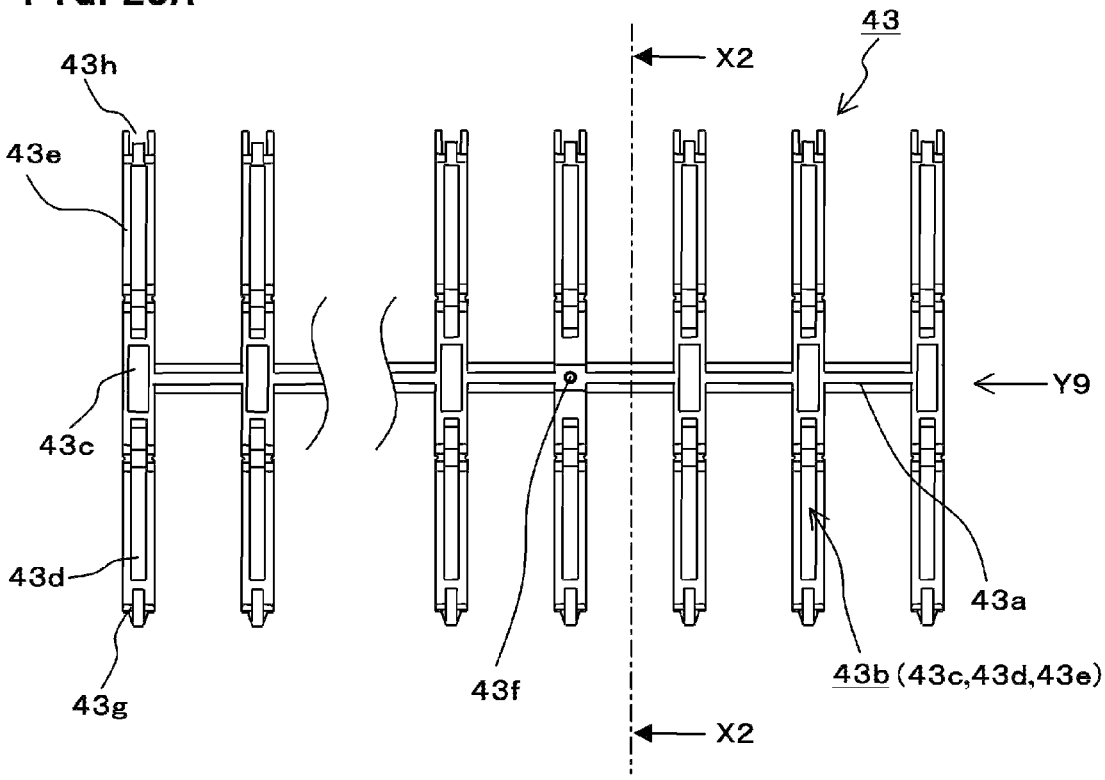
FIG. 23A is a plan view showing a portion of the binding component 43.
Figure 23B:
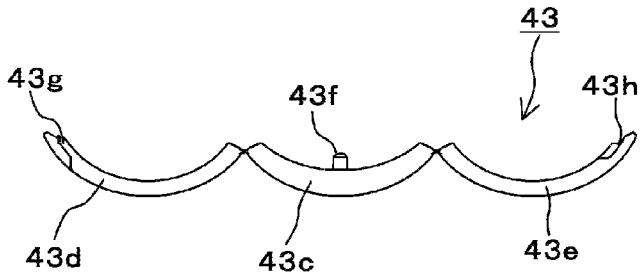
FIG. 23B is a diagram showing a state example of the binding component 43 in FIG. 23A seen from an arrow Y9.

Next, it will be explained with respect to the binding components 43 stored (set) inside the binder cassette 42 with reference to FIGS. 23 to 25. The binding component 43 shown in FIG. 23A is an injection molded component in which the ring portions 43*b* are aligned by constant intervals at a backbone portion 43*a* having the length in conformity with the dimensions of the standard-sized paper. As shown in FIG. 23B, the ring portion 43*b* is partitioned into three portions of a ring portion 43*c* connected to the backbone portion 43*a* and a ring portion 43*d* and a ring portion 43*e* which are jointed therewith on the right and the left sides to be freely bendable, and it has a constitution of a ring-like shape developed. Also, as shown in FIG. 23C, the cross-section of the backbone portion 43*a* becomes a shape having a base of a straight line and a convex portion at the center of the upper portion.

Figure 23C:
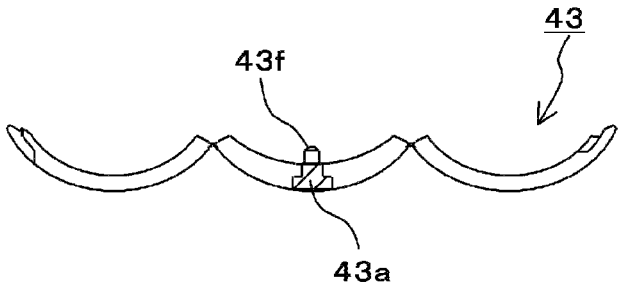
FIG. 23C is a cross-section diagram seen from X2-X2 arrows showing a configuration example of the binding component 43 in FIG. 23A.

Also, as shown in FIGS. 23A to 23C, the ring portion 43*c* of a predetermined ring portion 43*b* is provided with a convexity shaped pin 43*f*. There is provided on the opposite side of the ring portion 43*c* provided with the pin 43*f* with a fitting hole, which is not shown, corresponding to the pin 43*f*. Owing to this configuration, it becomes possible to stack the binding components 43 by being fitted with the fitting holes.

Figure 24:
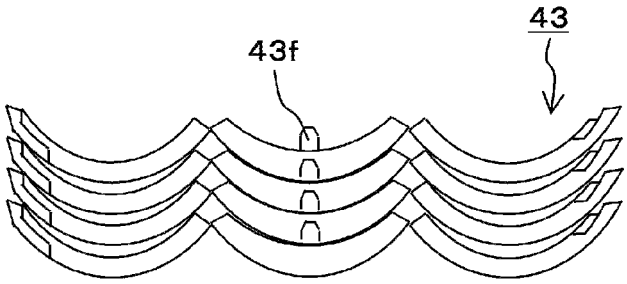
FIG. 24 is an explanatory diagram showing a configuration example of the stacked binding components 43.

According to the stacking example of the binding components 43 shown in FIG. 24, it is possible, in case of seeing from the arrow Y9 in FIG. 23A, to accomplish the stack by fitting the pins 43*f* into the fitting holes in a state in which the respective both end portions of the ring portion 43*d*, the ring portion 43*c* and the ring portion 43*e* shown in FIG. 23B are aligned approximately on a straight line.

When doing like this, it is possible to store a stack body (cartridge) of the binding components 43 inside the binder cassette 42. Furthermore, any one of the backbone portions 43*a* of the binding components 43 are positioned downward, so that it becomes possible for the binding component gripping portion 41*b* of the movement mechanism 41 to separate one piece of the binding component 43 from the stack body thereof with excellent reproducibility. Furthermore, the stack direction of the cartridges and the gravity direction coincide, so that separation performance is stabilized.

Here, it will be explained with respect to a binding example (Nos. 1 to 3 thereof) of the binding component 43 with reference to FIGS. 25A to 25C. The binding component 43 shown in FIG. 25A corresponds to one which was separated from the stack shaped binding components 43 shown in FIG. 24.

Figure 25A:
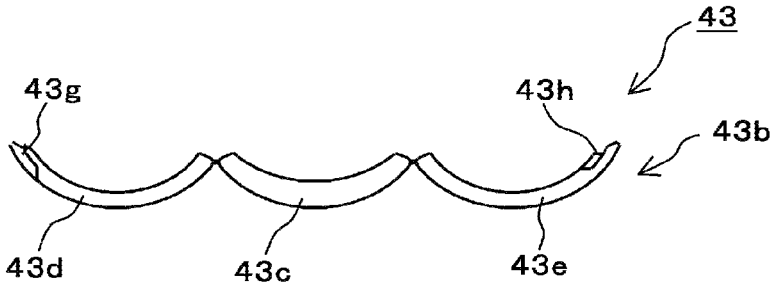
FIG. 25A is a process diagram showing a binding example (No. 1 thereof) of the binding component 43.

The ring portion 43*b* shown in FIG. 25A is constituted in the bend-free manner at a joint portion between the ring portion 43*d* and the ring portion 43*c* and a joint portion between the ring portion 43*c* and the ring portion 43*e*. In the embodiment, a coupling portion 43*q* provided in a tip portion of the ring portion 43*d* and a coupling portion 43*h* provided in a tip portion of the ring portion 43*e* are constituted in a couplable manner.

Figure 25B:
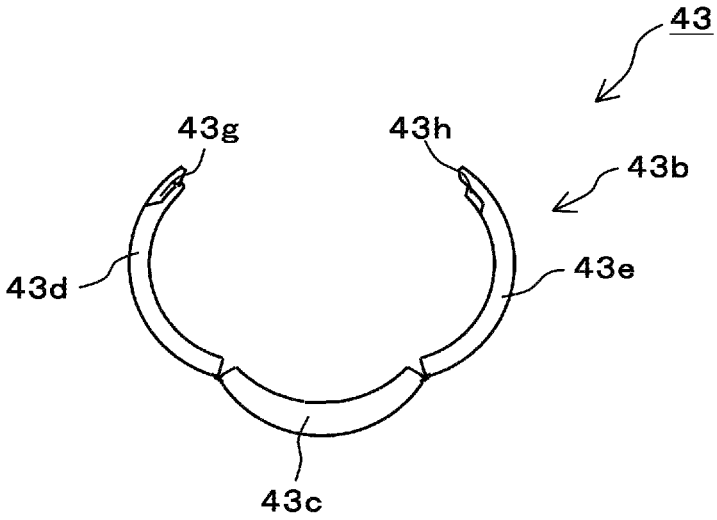
FIG. 25B is a process diagram showing a binding example (No. 2 thereof) of the binding component 43.
Figure 25C:
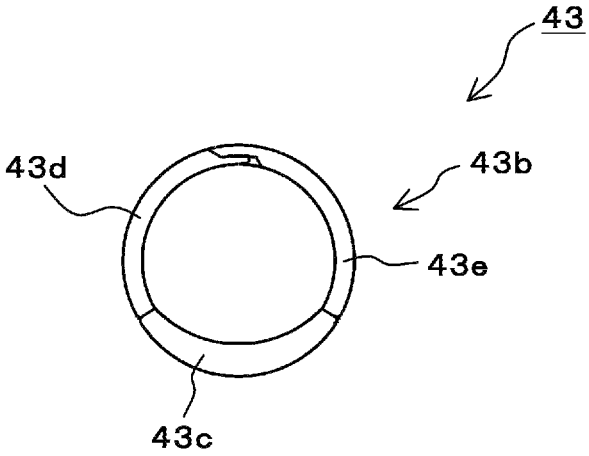
FIG. 25C is a process diagram showing a binding example (No. 3 thereof) of the binding component 43.

Thus, as shown in FIGS. 25A to 25C, it is constituted such that a perfect ring is possible to be formed by connecting the coupling portion 43*q* to the coupling portion 43*h*, by bending the ring portion 43*d* and ring portion 43*e* in the annular direction from the state in which respective both end portions of the ring portion 43*d*, the ring portion 43*c* and the ring portion 43*e* are aligned on a straight line. Also, the coupling portion 43*g* and the coupling portion 43*h* can carry out the coupling and removal in many times, thus being possible to reuse the binding component 43.

Also, with respect to the binding component 43 explained in FIGS. 23 to 25, a plurality of kinds in which the sizes or the like of the ring portion 43*b* are different are used in response to the thickness of the paper-sheet 3' and the bundle of paper-sheets 3". For example, the binding component for the large aperture ring which is the most suitable for the bundle of paper-sheets 3" more than the standard number of sheets, the binding component for the small aperture ring which is the most suitable for the bundle of paper-sheets 3" less than the standard number of sheets and the like are prepared.

Figure 26:
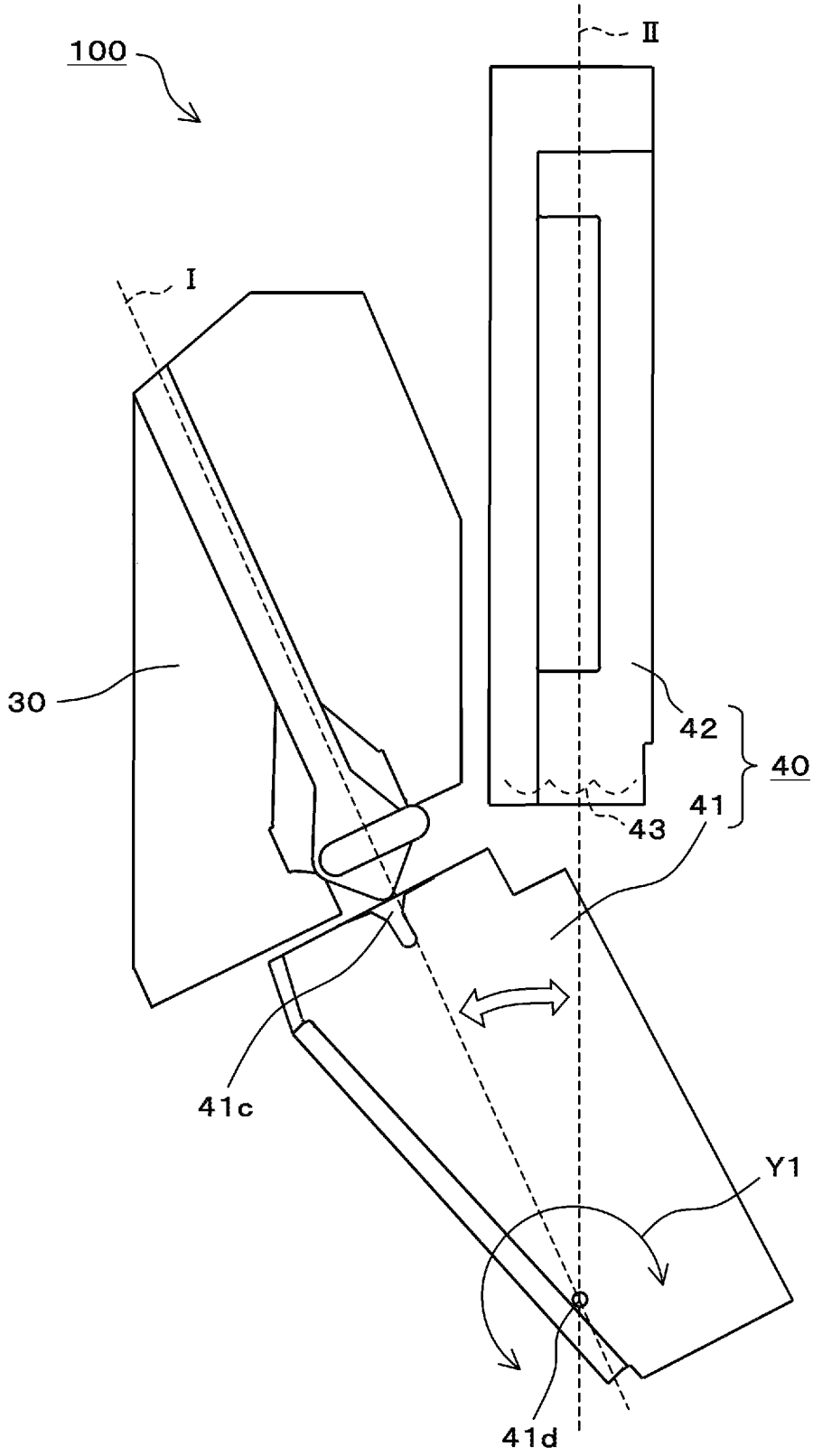
FIG. 26 is a constitution diagram showing a movement example at the time of a paper-sheet binding process of a binding process unit 40.

Subsequently, it will be explained with respect to a paper-sheet binding process example in the binding device 100 with reference to FIG. 26. The movement mechanism 41 shown in FIG. 26 is in a state of moving to the paper-sheet binding position. Here, the paper-sheet binding position is a position at which the movement mechanism 41 takes a posture such that the opening portion 41*c* faces the paper-sheet transporting direction of the binder paper alignment unit 30.

This posture is a posture in which the movement mechanism 41 located at the binding component extraction position shown in FIG. 3 rotates like the arrow Y1 by making the movement mechanism rotating axis 41*d* shown in FIG. 26 to be a reference. The rotation control of this movement mechanism 41 is carried out by driving the motor 45*a* for rotating movement mechanism based on the motor control signal S40 according to the control unit 50 shown in FIG. 20.

It is constituted according to the binding process unit 40 shown in FIG. 26 such that the booklet 90 is to be produced by binding the bundle of paper-sheets 3" using the binding component 43 in a coordinated manner of the binder paper alignment unit 30 and the movement mechanism 41 (paper-sheet binding process).

Here, a binding process example (Nos. 1, 2 thereof) of the binding component 43 by the movement mechanism 41 will be explained with reference to FIG. 27A and FIG. 27B. In this embodiment, it will be explained with respect to an operation example of the related members in the cross section of the movement mechanism 41.

In this embodiment, a case is assumed where the bundle of paper-sheets 3" is binding-processed by using one piece of binding component which lies in a half-bound state in a state in which the movement mechanism 41 lies at the paper-sheet binding position under the binder paper alignment unit 30. In this process, it is already in a state after the rotation from the binding component extraction position to the paper-sheet binding position was carried out.

Figure 27A:
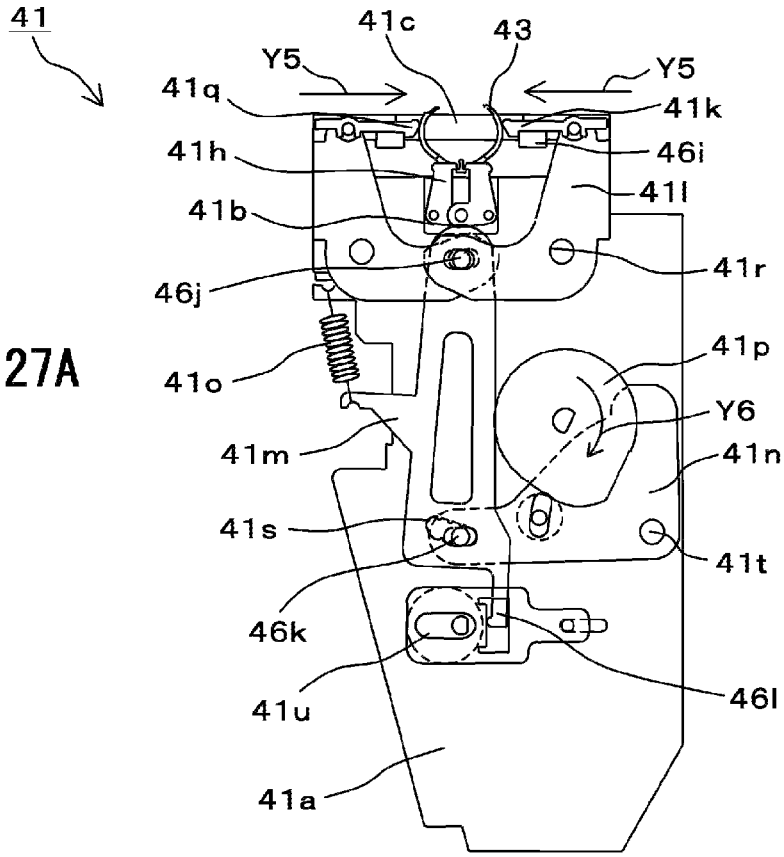
FIG. 27A is a process diagram showing a binding process example (No. 1 thereof) of the binding component 43 by the movement mechanism 41.

The binding component gripping portion 41*b* shown in FIG. 27A is in a state of being positioned at the lowermost portion and in a state of gripping one piece of binding component 43 by the binding component gripping claw 41*h*. In this embodiment, the movement mechanism 41 has a function of opening and closing the binding claw. In order to configure this function, the movement mechanism 41 is provided, for example, with the binding claws 41*k*, a binding claw link 41*l*, a binding claw link 41*m*, a binding portion link 41*n*, a spring 41*o*, a cam for the binding claws 41*p* and motor 45*d* for opening and closing the binding claws (see FIG. 20).

The binding claws 41*k* has a binding portion 41*q* contacting with the binding component 43 when binding the binding component 43 and is provided at the both side portions of the opening portion 41*c* and on the upper surface of the binding claw setting portion 46*i* along the longitudinal direction of the opening portion 41*c*. The respective binding claws 41*k* are jointed freely rotatably at the upper edge portions of the binding claw links 41*l* having L-shaped forms respectively. Each of the binding claw links 41*l* is mounted freely rotatably on the main body portion 41*a* at rotation portion 41*r* of the binding claw link, which is positioned approximately at the central portion at each of the binding claw links 41*l*.

Also, the two binding claw links 41*l* are jointed freely rotatably at a link coupling portion 46*j* positioned at the edge portion on the opposite sides of the edge portions at which the binding claws 41*k* are jointed. Further, the two binding claw links 41*l* are jointed freely rotatably with the upper edge portion of the binding claw link 41*m*, which has a predetermined length in the up and down direction at the link coupling portion 46*j*.

The binding claw link 41*m* has a coupling hole 41*s* of the binding claw link, which has a long-hole shape, at the lower edge portion. A convexity shaped link coupling portion 46*k* of the binding portion link 41*n* is fitted into the coupling hole 41*s* of the binding claw link and the binding claw link 41*m* and the binding claw link 41*n* are jointed freely rotatably. Also, the binding claw link 41*m* is mounted on the main body portion 41*a* at the center portion thereof through the spring 41*o*. Depending on this spring 41*o*, it becomes in a state in which force is added to the binding claw link 41*m* in the clockwise direction of FIG. 27A and FIG. 27B by making the link coupling portion 46*i* and the link coupling portion 46*k* to be axes.

The binding claw link 41*n* is mounted freely rotatably on the main body portion 41*a* at a rotating axis 41*t* of the binding claw link. Also, it is constituted such that the binding claw link 41*n* rotates on the axis of the rotating axis 41*t* of the binding claw link owing to a fact that the cam for the binding claws 41*p* rotates as shown by an arrow Y6 and an arrow Y8.

By being provided with the constitution as mentioned above, a closing operation of the binding claws 41*k* are carried out from the state shown in FIG. 27A to the state shown in FIG. 27E as described hereinafter. The cam for the binding claws 41*p* rotates in the clockwise direction in FIG. 27A shown by the arrow Y6, the binding claw link 41*n* rotates counterclockwise, and the downward force is imposed onto the binding claw link 41*m*. As a result thereof, the binding claw link 41*l* shown on the right side of FIG. 27A is added with the counterclockwise force and the binding claw link 41*l* shown on the left side of FIG. 27A is added with the clockwise force respectively, and the respective binding claws 41*k* move to the direction shown by the arrows Y5 and the binding claws 41*k* are closed.

The opening operation of the binding claws 41*k* from the state shown in FIG. 27B to the state shown in FIG. 27A is carried out as described hereinafter. The cam for the binding claws 41*p* rotates in the counterclockwise direction in FIG. 27B shown with arrow Y8, the binding claw link 41*n* rotates clockwise, and the upward force is imposed onto the binding claw link 41*m*. As a result thereof, the binding claw link 41*l* shown on the right side of FIG. 27B is added with the clockwise force and the binding claw link 41*l* shown on the left side of FIG. 27B is added with the counterclockwise force respectively, and the respective binding claws 41*k* move to the direction shown by the arrows Y7 and the binding claws 41*k* are opened.

The control of the open-close operation of the binding claws 41*k* is carried out according to the control unit 50 shown in FIG. 20 by driving the motor for opening and closing the binding claws 45*d* based on the motor control signal S43 and by rotating the cam for the binding claws 41*p*.

Also, there is provided at the lower side portion of the binding claw link 41*m* with a cam for adjusting the binding component 41*u* and owing to the fact that this cam for adjusting the binding component 41*u* rotates, a rotating force is added to the binding claw link 41*m* through the binding component adjustment portion 46*l* by making the link coupling portion 46*i* to be an axis, and the position of the link coupling portion 46*k* in the coupling hole of the binding claw link is changed. As a result thereof, the base position in the upper and downward directions of the binding claw link 41*m* is changed and base positions of the respective binding claws 41*k* in the state in which the binding claws 41*k* is open as shown in FIG. 27A and in the state in which the binding claws 41*k* is closed as shown in FIG. 27B are also changed. Thus, it becomes possible to correspond to the binding components 43 having the ring portions different in size.

Subsequently, it will be explained with respect to a booklet production example (Nos. 1 to 4 thereof) by the binder paper alignment unit 30 and the binding process unit 40 with reference to FIGS. 28A to 28D. In this embodiment, it will be explained with respect to an operation example of the related members in the cross section of the movement mechanism 41.

A case is assumed in this embodiment in which the binder paper alignment unit 30 aligns a plurality of paper-sheets 3' and the booklet 90 is produced by binding the bundle of paper-sheets 3" thereof according to the binding process unit 40 by using the binding component 43. It is needless to say that the paper-sheet detecting sensor 119 counts the number of sheets of the paper-sheet 3' stored in the binder paper alignment unit 30 and outputs the paper-sheet detection signal Sc to the control unit 50. The control unit 50 is operated so as to control the clamp movement mechanism 80 and the binding process unit 40 when the bundle of paper-sheets 3" reaches the defined number of sheets based on the paper-sheet detection signal Sc. For example, the control unit 50 is shifted to the binding component acquisition control when the paper-sheet detection signal Sc to the effect that one sheet of the paper-sheet 3' was detected is inputted from the paper-sheet detecting sensor 119 and is shifted to the clamp movement control of the bundle of paper-sheets 3" in the clamp movement mechanism 80 when the bundle of paper-sheets 3, reaches the defined number of sheets.

Figure 28A:
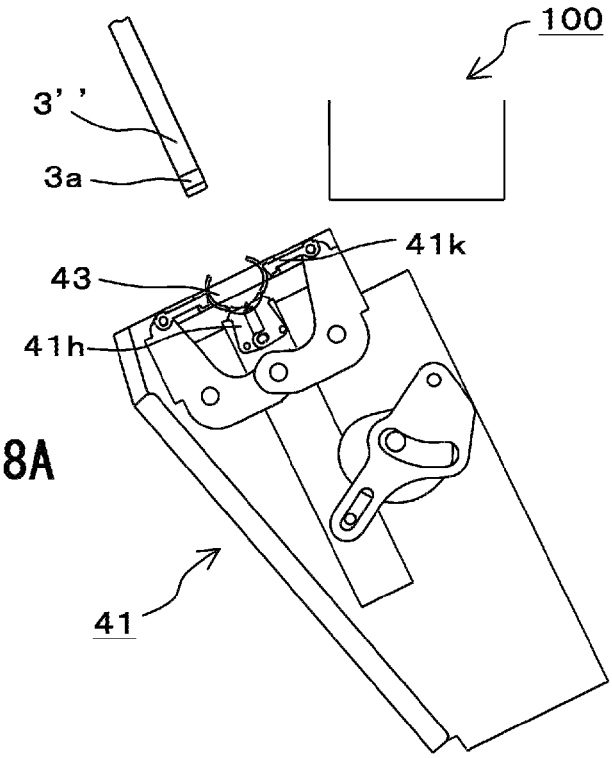
FIG. 28A is a process diagram showing a booklet production example (No. 1 thereof) by the binder paper alignment unit 30 and the binding process unit 40.

Making these to be control conditions, first, in the binding process unit 40, the movement mechanism 41 shown in FIG. 28A is moved to the paper-sheet binding position after carrying out the first forming of the binding component 43. At that time, the movement mechanism 41 directs the center of the binding component 43 in a half-bound state to the upward direction. On the one hand, in the binder paper alignment unit 30 which is not shown, the bundle of paper-sheets 3" is held by the clamp members 82*a*, 82*b* and is descended by utilizing the clamp position determining function and the downward movement adjusting function of the clamp movement mechanism 80 shown in FIG. 13A and FIG. 13.

For example, the control unit 50 controls the clamp movement mechanism 80 through the motor drive units 180 to 183. The motor drive unit 181 is inputted with the movement control signal S81 from the control unit 50 and drives the motor for clamp drive 86, and drive-controls the clamp members 82*a*, 82*b* shown in FIG. 5. Also, the motor drive unit 180 is inputted with the movement control signal S80 from the control unit 50 and drives the motor for the shutter 308, and controls the shutter 83 shown in FIG. 5 to be opened and closed.

Figure 28B:
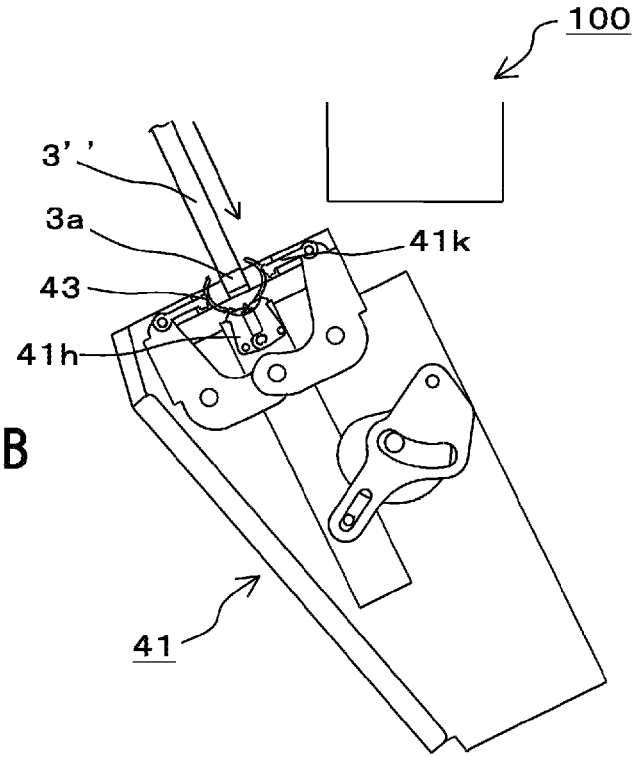
FIG. 28B is a process diagram showing a booklet production example (No. 2 thereof) by the binder paper alignment unit 30 and the binding process unit 40.

The clamp members 82*a*, 82*b* hold the bundle of paper-sheets 3" of the standard number of sheets and move to the downstream side along the paper-sheet transporting direction in a state of holding bundle of paper-sheets 3" with respect to the main body substrate 81 shown in FIG. 5. Thereafter, as shown in FIG. 28B, the bundle of paper-sheets 3" is moved with respect to the binding component 43 by the binder paper alignment unit 30 which is not shown. In this embodiment, being directed to the center of the binding component 43 in the half-bound state which the binding process unit 40 provides, the clamp movement mechanism 80 maintains the state of clamping the bundle of paper-sheets 3" and the clamp members 82*a*, 82*b* descend.

The clamp members 82*a*, 82*b* descend (move) to the binding process unit side by the offset distance L1 as shown in FIG. 13B by making the home position of the fulcrum axis member 805 to be a reference. The clamp movement mechanism 80 operates during the descent of the clamp members 82*a*, 82*b* such that the center position of the paper-sheet transport and the binding center position are to coincide.

Figure 28C:
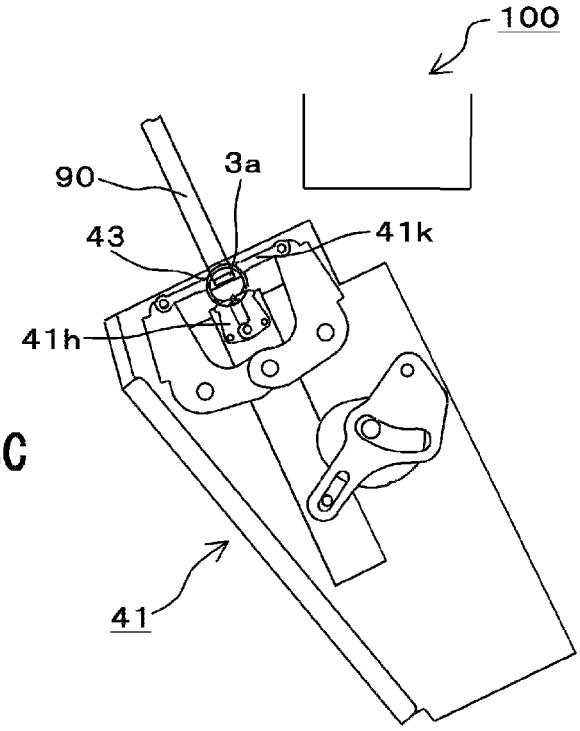
FIG. 28C is a process diagram showing a booklet production example (No. 3 thereof) by the binder paper alignment unit 30 and the binding process unit 40.

Thereafter, when the punch holes 3*a* of the bundle of paper-sheets 3" reach the center of the binding component 43 in the half-bound state, it is constituted in the movement mechanism 41, as shown in FIG. 28C, such that the binding claws 41*k* are closed, the ring portion 43*b* is completely closed passing through the respective punch holes 3*a* of the bundle of paper-sheets 3" and the bundle of paper-sheets 3" is to be binding-processed by the binding component 43. The motor drive unit 44*d* drives the motor 45*d* based on the motor control signal S43. The motor 45*d* drives the binding claws 41*k* to be opened and closed based on the motor control signal S43 from the control unit 50.

Figure 27B:
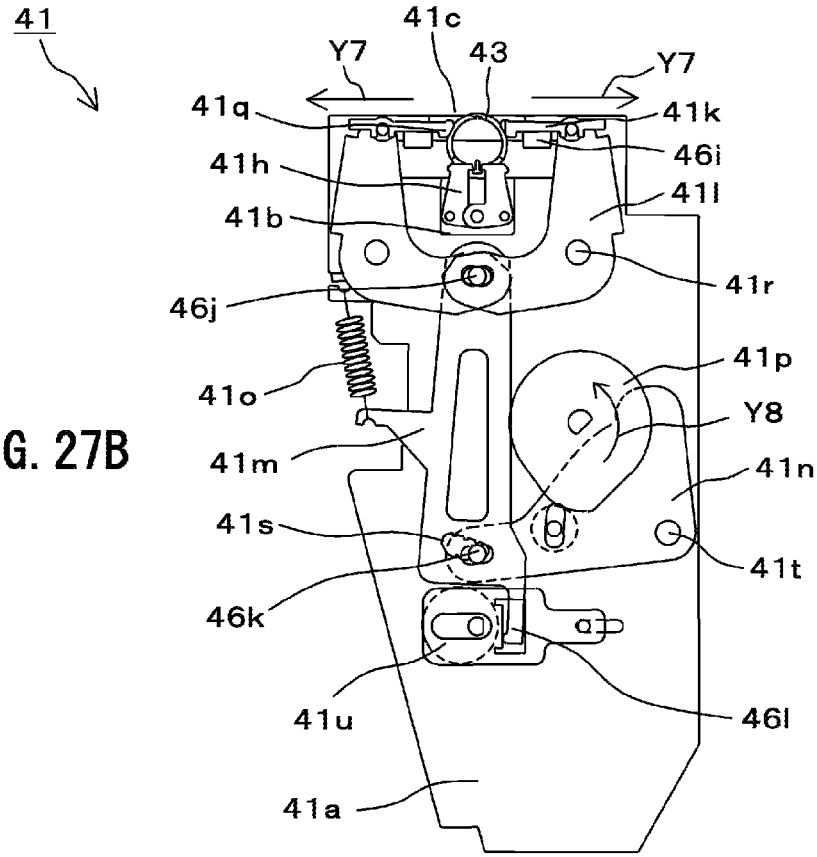
FIG. 27B is a process diagram showing a binding process example (No. 2 thereof) of the binding component 43 by the movement mechanism 41.

It is as shown from FIG. 27A to FIG. 27B with respect to the closing operation of the binding claws 41*k* at that time. Such a binding processing process is referred to as a real binding processing process of the binding component 43. Thus, it becomes possible to binding-process the punch holes 3*a* of the bundle of paper-sheets 3" by means of the binding component 43. The bundle of paper-sheets 3" binding-processed by means of the binding component 43 becomes the booklet 90.

Figure 28D:
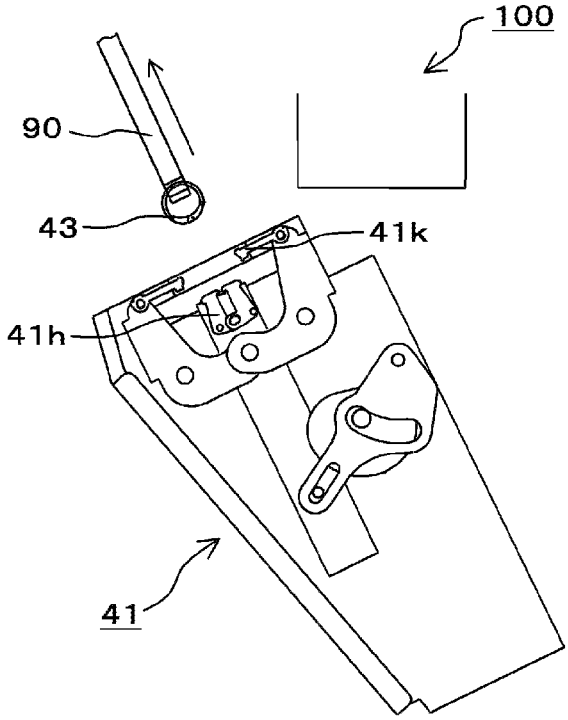
FIG. 28D is a process diagram showing a booklet production example (No. 4 thereof) by the binder paper alignment unit 30 and the binding process unit 40.

Thereafter, the binding claws 41*k* are opened and the binding component gripping claws 41*h* are opened as shown in FIG. 28D. At that time, it is as shown from FIG. 27B to FIG. 27A with respect to the opening operation of the binding claws 41*k*. After the opening operation of the binding claws 41*k*, the motor drive unit 44*c* drives the motor 45*c* based on the motor control signal S42. The motor 45*c* opens the binding component gripping claws 41*h* based on the motor control signal S42 from the control unit 50. Thereafter, in the binder paper alignment unit 30, the booklet 90 is moved once so as to be pulled up to the upstream side. This is for securing a region for the return operation of the movement mechanism 41.

In this embodiment, the clamp movement mechanism 80 maintains a state of clamping the booklet 90 and the clamp members 82*a*, 82*b* uprise. The clamp members 82*a*, 82*b* return to the home position of the fulcrum axis member 805. They uprise (retract) to the punching process unit side by the offset distance L1 shown in FIG. 13B.

After the retraction of these clamp members 82*a*, 82*b*, the movement mechanism 41 rotates reversely by making the movement mechanism rotating axis 41*d* shown in FIG. 26 to be a reference and returns to the binding component extraction position. The rotation control of this movement mechanism 41 is carried out by driving the motor 45*a* for rotating the movement mechanism based on the motor control signal S40 according to the control unit 50 shown in FIG. 20. For example, the motor 45*a* drives the movement mechanism 41 based on the motor control signal S40.

After the returning of the rotation of this movement mechanism 41, the clamp members 82*a*, 82*b* are released freely in the binder paper alignment unit 30 and the booklet 90 held by aforesaid clamp members 82*a*, 82*b* is made so as to fall naturally by way of the booklet through pass path Y2. The booklet 90 after falling naturally is caught by the releasing unit 60 and it is operated so as to shift to an output process.

In this manner, there is provided according to the binding device as an embodiment with an arrangement structure forming approximately a V-shape in which the movement mechanism 41 of the binding process unit 40 is arranged on the downstream side of the binder paper alignment unit 30 and the binder cassette 42 and also, the binder paper alignment unit 30 and the binder cassette 42 are arranged radially on the upstream side by making aforesaid movement mechanism 41 to be a reference. The movement mechanism rotating axis 41*d* of the binding process unit 40 is arranged in a region in which the direction outputting the bundle of paper-sheets 3" from the binder paper alignment unit 30 to the downstream side and the direction outputting the binding component 43 from the binder cassette 42 to the downstream side intersect.

Consequently, not only two processes of the separation acquisition process of the binding component 43 and the binding process of the binding component 43 can be executed centering around the movement mechanism rotating axis 41*d*, but also necessary constructional elements such as the binder paper alignment unit 30, the binder cassette 42 and the like can be concentrated at the periphery of the binding process unit 40, so that it becomes possible for the arrangement of the component members in the horizontal direction of the device to be repressed. Thus, a constitution in which these constitution members are arranged on a straight line can be avoided, so that it is possible to attempt miniaturization of the binding device 100.

Other than that, there are advantages as follows.

i. It is possible for the two sets of the binder paper alignment unit 30 & the movement mechanism 41 and the movement mechanism 41 & the binder cassette 42 to provide a process switchable structure easily in aforesaid movement mechanism 41.

ii. The movement mechanism 41 comes not to be affected by the arrangement of the binder cassette 42.

iii. Miniaturization of the binder cassette 42 can be attempted and increase in the loading number of the binding components can be attempted caused by the miniaturization thereof.

iv. The space region after the movement mechanism 41 retracts can be utilized for the booklet through pass path Y2 in the output route of the binder paper alignment unit 30, so that simplification of the output mechanism can be attempted.

v. It is also possible during the bind paper alignment to carry out from the separation of the binding component 43 to the movement of the binding component, so that productivity is improved (heightened) by employing a parallel process thereof.

vi. By making the binding component 43 to be multiple and by making the binder paper alignment unit 30 to be multiple in the future, it is possible to carry out replacement of the movement mechanism 41 which is a binding movable portion easily and it is possible to heighten the added value of commodity.

It was explained in the embodiments mentioned above with respect to a case in which the movable portion of the movement mechanism 41 is a hinge type, but it is not limited by this and a similar effect can be obtained even in a case of a parallel movement type. Here, it is enough for the binder paper alignment unit 30, the movement mechanism 41 and the binder cassette 42 explained in the embodiments to bring out their functions depending on the relative movements thereof and a case is also allowed in which the movement mechanism 41 is fixed and the binder paper alignment unit 30, the binder cassette 42 and the like will take movable modes.

INDUSTRIAL APPLICABILITY

The invention is very preferable to be applied to a binding device for automatically carrying out the binding processing to the recording paper-sheets outputted from a copy machine or a print machine for black-and-white use and for color use.

The invention claimed is:

1. A paper-sheet handling device comprising:

paper-sheet storage means for receiving perforated paper-sheets delivered to the paper-sheet storage means and temporarily storing a plurality of perforated paper-sheets in a state in which the perforated paper-sheets are aligned, and for releasing a bound bundle of aligned paper-sheets in a predetermined direction along a path;

binding means for binding a bundle of aligned paper-sheets stored in said paper-sheet storage means using a binding component; and a binder cassette for storing binding components and for releasing a binding component to be transferred to said binding means, wherein said binding means is arranged downstream of said paper-sheet storage means with respect to said predetermined direction and said binding means is pivotally displaceable about a rotation axis between a first position facing said paper-sheet storage means and a second position facing said binder cassette, for receiving a binding component from the binder cassette, said rotation axis is arranged in the vicinity of a region where said predetermined direction intersects a direction in which binding components are released from said binder cassette to be transferred to the binding means, said binding means contains a movement mechanism which moves the binding means pivotally about said rotation axis between said first position and said second position, and said binding means moves pivotally about said rotation axis to the second position to remove a binding component of a predetermined size from the binder cassette, moves pivotally about said rotation axis to the first position while holding said removed binding component, thereby transferring the removed binding component to a position for binding the bundle of paper-sheets stored in said paper-sheet storage means, and binds the bundle of paper-sheets by means of said binding component.

2. The paper-sheet handling device according to claim 1, wherein said binding means receives the binding component from said binder cassette while said paper-sheet storage means aligns the paper-sheets.

3. The paper-sheet handling device according to claim 1, wherein a booklet through-pass path is defined in a direction in which a bound bundle of paper-sheets is released from said paper-sheet storage means to the downstream side when said binding means is in the second position.

4. The paper-sheet handling device according to claim 1, wherein said binding means moves pivotally about said rotation axis to the second position to receive a binding component of a predetermined size, moves pivotally about said rotation axis to the first position while holding said received binding component, whereby the binding component is transferred to a position facing the bundle of paper-sheets, and binds the bundle of paper-sheets by means of said binding component.

5. The paper-sheet handling device according to claim 1, wherein said rotational axis is arranged substantially at an intersection of said predetermined direction intersects and said direction in which binding components are released from said binder cassette to be transferred to the binding means.

6. The paper-sheet handling device according to claim 1, further comprising control means, and wherein said binding means comprises a movement mechanism main body portion, a binding component gripping portion that is displaceable relative to movement mechanism main body portion between a retracted position inside the movement mechanism main body portion and a projecting position outside the movement mechanism main body portion, and a gripping claws displacement mechanism coupled to the binding component gripping portion and responsive to the control means for displacing the binding component gripping portion and responsive to the control means for displacing the binding component gripping portion between the retracted position and the projecting position, whereby when the binding means is in the second position the gripping claims displacement mechanism displaces the binding component gripping portion from the retracted position to the projecting position, in which the binding component gripping portion engages the binding component in the binder cassette, and displaces the binding component gripping portion from the projecting position to the retracted position, whereby the binding component gripping portion extracts the gripped binding component from the binder cassette.

7. The paper-sheet handling device according to claim 6, wherein said binding means comprises gripping claws that are displaceable relative to the movement mechanism main body portion between an open position for receiving the binding component when the binding means is in the second position and a closed position for closing the binding component to bind the bundle of paper-sheets stored in said paper-sheet storage means when the binding means is in the first position, and a gripping claws displacement mechanism coupled to the gripping claws and responsive to the control means for displacing the gripping claws between the open position and the closed position.

* * * * *